US006547643B1

(12) United States Patent
Miller, III et al.

(10) Patent No.: US 6,547,643 B1
(45) **Date of Patent: *Apr. 15, 2003**

(54) SURFACE POLISHING APPLICATOR SYSTEM AND METHOD

(75) Inventors: Paul David Miller, III, Dallas, TX (US); Dennis L. Dehn, Dallas, TX (US)

(73) Assignee: Auto Wax Company, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/005,102

(22) Filed: Jan. 9, 1998

Related U.S. Application Data

(63) Continuation-in-part of application No. 08/781,768, filed on Jan. 10, 1997.

(51) Int. Cl.[7] ..... B24B 1/00
(52) U.S. Cl. ..... 451/28; 451/507; 451/524
(58) Field of Search ..... 451/59, 28, 461, 451/523–525, 490; 15/229.13

(56) References Cited

U.S. PATENT DOCUMENTS

| | | | |
|---|---|---|---|
| 1,966,101 | A | 7/1934 | Miller |
| 2,375,585 | A | 5/1945 | Rimer |
| 2,589,782 | A | 3/1952 | Creek |
| 3,521,412 | A | 7/1970 | McCarty |
| 3,576,779 | A | 4/1971 | Holdstock et al. |
| 3,634,973 | A | 1/1972 | McCarty |
| 3,909,217 | A | 9/1975 | Perry |
| 4,064,061 | A | 12/1977 | Henry |
| 4,087,943 | A | 5/1978 | Perry |
| 4,128,972 | A | 12/1978 | Charvat |
| 4,150,955 | A | 4/1979 | Samuelson |
| 4,218,250 | A | 8/1980 | Kasprzak |
| 4,264,337 | A | 4/1981 | Fenster et al. |
| 4,308,060 | A | 12/1981 | Talbot |
| 4,343,910 | A | 8/1982 | Busch, Jr. et al. |
| 4,421,526 | A | 12/1983 | Strickman et al. |
| 4,484,419 | A | 11/1984 | Freerks |
| 4,512,859 | A | 4/1985 | Inoue |
| 4,670,500 | A | 6/1987 | Gupta |
| 4,920,704 | A | 5/1990 | Caserta et al. |
| 4,955,747 | A | 9/1990 | Tarver |
| 4,962,562 | A | 10/1990 | Englund et al. |
| 5,003,659 | A | 4/1991 | Paepke |
| 5,007,128 | A | 4/1991 | Englund et al. |
| 5,017,222 | A | 5/1991 | Cifuentes et al. |
| 5,066,724 | A | 11/1991 | Reich et al. |

(List continued on next page.)

FOREIGN PATENT DOCUMENTS

| | | |
|---|---|---|
| EP | 0 196 832 | 10/1986 |
| EP | 0 628 382 A1 | 12/1994 |
| GB | 836794 | 6/1960 |

(List continued on next page.)

OTHER PUBLICATIONS

Video Tape entitled Auto Magic '6 Stages of Reconditioning' (Complete Process—2:05;00) No. 91700, Auto Wax., Inc. Jan. 1994.

(List continued on next page.)

*Primary Examiner*—Robert A. Rose
(74) *Attorney, Agent, or Firm*—Eric B. Meyertons

(57) ABSTRACT

System and method for locating and polishing a stain or protrusion on a surface of a vehicle. The stain or protrusion may be located by placing a plastic film between a portion of a human hand and the surface. The stain or protrusion may then be removed and/or polished by applying an applicator containing a plastic flexible tool to the stain or protrusion. The applicator may include a body made of flexible or compressible material having a cavity into which a variety of polishing tools may be disposed.

174 Claims, 15 Drawing Sheets

U.S. PATENT DOCUMENTS

| | | | |
|---|---|---|---|
| 5,094,687 | A | 3/1992 | Elepano |
| 5,123,139 | A | 6/1992 | Lepper et al. |
| 5,125,191 | A | 6/1992 | Rhoades |
| 5,152,809 | A | 10/1992 | Mattesky |
| 5,174,813 | A | 12/1992 | Cifuentes et al. |
| 5,185,964 | A | 2/1993 | Englund et al. |
| 5,203,123 | A | 4/1993 | Traub |
| 5,203,883 | A | 4/1993 | Perry |
| 5,209,760 | A | 5/1993 | Wiand |
| 5,273,558 | A | 12/1993 | Nelson |
| 5,295,333 | A | 3/1994 | Püschner |
| 5,389,032 | A | 2/1995 | Beardsley |
| 5,396,737 | A | 3/1995 | Englund et al. |
| 5,442,816 | A | 8/1995 | Seketa |
| 5,476,416 | A | 12/1995 | Kodate |
| 5,489,233 | A | 2/1996 | Cook et al. |
| 5,514,192 | A | 5/1996 | Grigsby, Jr. |
| 5,551,960 | A | 9/1996 | Christianson |
| 5,676,714 | A | 10/1997 | Kodate |
| 5,716,259 | A | 2/1998 | Miller |
| 5,727,993 | A | 3/1998 | Kodate |
| 5,846,123 | A | 12/1998 | Brown et al. |
| 5,904,758 | A | 5/1999 | Kucala, III |
| 5,928,064 | A | 7/1999 | Miller |
| 6,241,579 | B1 | 6/2001 | Miller, III et al. |

FOREIGN PATENT DOCUMENTS

| | | |
|---|---|---|
| GB | 1 518 431 | 7/1978 |
| JP | 1-97572 | 4/1989 |
| JP | 4-11335 | 2/1992 |
| JP | 95005920 B2 | 5/1994 |
| JP | 7-5920 | 1/1995 |
| WO | 92/00153 | 1/1992 |
| WO | 92/0153 | 2/1992 |
| WO | 96/15877 | 5/1996 |

OTHER PUBLICATIONS

Video Tape entitled "Clay Magic—Clay Magic raceway 4 Minute Demo", Jul. 1994.

Video Tape entitled "Clay Magic—Miami Grand Prix 2 Minute Car Wash DR Spot", Mar. 1994.

Video Tape entitled "Auto Wax Company, Inc., Tip Tape Series 1, 1–14," Sep. 1991.

Video Tape entitled Clay–Magic.TM. Demonstration (10:53)—No. 91333, Copyright.Auto Wax Company, Inc. 1994.

Cryovac, "MPD 2055 Film," 2 pages (publication date is unknown but it is at least as early as Oct. 1995.

English translation of Japanese Patent Application 4–11335 (Feb. 28, 1992).

English translation of Japanese Patent Application 1–97572 (Apr. 17, 1989).

Patent Abstracts of Japan, vol. 013, No. 310 (M–850), Jul. 14, 1989 & JP 01 097572 A (Tadao Koyakata), Apr. 17, 1989.

PCT International Search Report for PCT/US 96/17416, dated Mar. 4, 1997.

PCT Interantional Search Report for PCT/US 98/00540, dated Jun. 22, 1998.

International Preliminary Examination Report for Application No. PCT/US98/00540 mailed Apr. 16, 1999.

SURFACE POLISHING APPLICATOR SYSTEM AND METHOD

RELATED APPLICATION

This application is a continuation-in-part of copending U.S. patent application Ser. No. 08/781,768 filed Jan. 10, 1997 entitled "Surface Polishing Applicator System and Method".

BACKGROUND OF THE INVENTION

1. Field of the Invention

The present invention relates to a method and system for use in removing and/or polishing a stain and/or protrusion from a surface, especially a surface of an automobile.

2. Brief Description of the Related Art

When rolling stocks (e.g., automobiles) are placed in parking lots near railways and iron works, or in places close to construction sites where a coating operation is conducted, iron powder and paint mist tend to gather on the coated surface of the rolling stocks and adhere thereto to form minute protrusions. Such unfavorable protrusions may be difficult to see with a human eye. Conventionally, such protrusions were removed by polishing the surface using a compound or a sand paper.

When a compound or sand paper is applied to a surface to remove protrusions, not only are the protrusions brought into contact with the abrasive, but the coated surface is brought into contact with the abrasive as well. Thus, scratches or flaws may be formed on the coated surface. As illustrated schematically in FIG. 3(*a*), it can be seen that this conventional method of polishing tends to suffer from poor operability, because the abrasive force tends to be fully exerted on the coated surface as well as the protrusions if and when the abrasive force is fully applied to the protrusions.

With a view toward ameliorating the poor operability of the conventional method, practitioners have previously proposed in U.S. Pat. No. 5,476,416, a plastic flexible tool including a plastic flexible material having mixed therewith fine abrasives such as silica sand and calcium carbonate. U.S. Pat. No. 5,476,416 matured from U.S. patent application Ser. No. 08/102,972 and is incorporated hereby by reference as if fully set forth herein.

As noted previously, some surface imperfections may be minute and/or "blend" with the surface in certain light. Thus, some stains and/or protrusions may be relatively difficult to see with a human eye. Since a plastic flexible tool tends to be selectively applied by a practitioner, the practitioner may not readily see a surface imperfection when applying the plastic flexible tool. Thus, some surface imperfections may not be treated by the practitioner with the plastic flexible tool. For instance, a practitioner may apply the plastic flexible tool to an automobile on a cloudy day and not treat surface imperfections which are more visible on a sunny day. Costly and/or tedious repeat treatments may be necessitated.

SUMMARY OF THE INVENTION

An advantage of the present invention is obtaining a relatively smooth and/or clean coated surface by polishing and/or removing a stain or protrusion from the surface. Accordingly, the present invention includes locating a surface protrusion or stain and then controlling both the polishing force being exerted to the protrusion or stain and the polishing force being applied to the planar surface.

A method of the invention may include:

covering at least a portion of a human hand with a plastic film;

determining the location of a stain or protrusion on the surface by touching the surface with at least a portion of the covered human hand, wherein plastic film is between the portion of the human hand and the surface while the surface is being touched;

applying a plastic flexible tool to the stain or protrusion, the plastic flexible tool including a plastic flexible material having an abrasive mixed therewith; and applying a force to the plastic flexible tool such that a polishing force is applied by the plastic flexible tool to the stain or protrusion on the surface.

One system of the invention may include:

a plastic film sized and adapted to cover at least a portion of a human hand, the plastic film having a thickness of between 0.1 mm and 0.75 mm; and a plastic flexible tool including a plastic flexible material having an abrasive mixed therewith.

The abrasive may include grains from about 3 to 50 $\mu$m in diameter.

The ability of the human hand to feel a stain or protrusion on the surface is enhanced by the plastic film. If properly made and applied, the plastic film tends to exaggerate and accent the feel of such protrusions.

The surface may be the surface of a vehicle such as an automobile, motorcycle, boat, truck, plane, or train. The surface may be coated or painted. The surface may also include coated or uncoated plastic materials. Examples of plastic materials include, but are not limited to PLEXIGLAS or LEXAN. The surface may also include glass.

The plastic film is preferably substantially transparent. In this manner the practitioner can see the area in which poorly visible protrusions are located by feel. The plastic film may include a polyolefin, polystyrene, parafilm, and polyethylene. The plastic film may include elastomer material and/or an acrylic or methacrylic material.

The plastic film is preferably not too thin or too thick. If the film is too thin, then its strength and durability may be reduced. If the film is too thick, then the sense of touch may be reduced. Preferably the plastic film is less than about 1.0 mm thick, more preferably between about 0.1 mm and less than about 0.75 mm thick, and more preferably still at a thickness of 0.5 mm. The plastic film is preferably sufficiently thin such that tactile sensitivity of the covered portion of the human hand to a surface protrusion is increased.

The plastic film preferably covers at least a portion of a human finger. The plastic film may be in the following shapes: flat and/or substantially planar, glove, mitten, envelope, sleeve, bowl, or finger cot.

One method may include checking the amount of removal of the stain or protrusion on the surface after the flexible plastic tool has been applied. The checking may be accomplished by touching at least a portion of a partially and/or totally covered human hand onto the surface, wherein plastic film is between the portion of the human hand and the surface while the surface is being touched.

One method may include pressing the plastic flexible tool against the surface, thereby deforming the plastic flexible tool to form a substantially flat surface on the plastic flexible tool. The plastic flexible tool may preferably be pressed against the surface such that the protrusion substantially embeds itself into the substantially flat surface of the plastic flexible tool. One preferred method includes reciprocating the substantially flat surface of the plastic flexible tool on the surface such that the protrusion protrudes into the plastic flexible tool and is brought into contact with abrasive inside the plastic flexible tool. Preferably the abrasive is substantially buried inside the plastic flexible tool such that the abrasive does not substantially protrude from the substantially flat surface of the plastic flexible tool.

Preferably the surface is not forcefully contacted with abrasive. Preferably the amount of force applied to the surface is about 1/30 to 1/200 (or, more preferably still, 1/80 to 1/100) of the amount of force applied to the protrusion. In one embodiment about 0.5 to 3.0 percent of force applied to the protrusion is substantially simultaneously applied to the surface.

A lubricant and/or water may be added to the surface such that the lubricant and/or water is between the plastic flexible tool and the surface while the plastic flexible tool is being applied to the surface.

Preferably the stain or protrusion is removed from the surface without substantially scratching the surface.

In an embodiment, an applicator is preferably used to guide the plastic flexible tool during polishing. The applicator may include a body having a top section and a bottom section. The bottom section preferably includes a substantially compressible material, and the top section may be constructed of a material that is more rigid than the compressible material of the bottom section. The top and bottom sections of the applicator may be secured together with glue or with a pressure-sensitive adhesive disposed between the sections.

A cavity for containing the plastic flexible tool is preferably formed in the bottom section. The cavity may have an inner surface that adheres to the plastic flexible tool to maintain it within the cavity while the applicator is reciprocated across a surface during polishing. The inner surface of the cavity may be formed by a lower portion of the top section of the body. The inner surface of the cavity may be serrated or contain convolutions to increase adhesion between the plastic flexible tool and the inner surface of the cavity.

The applicator body preferably includes a foam having between about 60 pores per inch and about 150 pores per inch. The top section may be constructed of a plastomer foam, while the bottom section may be constructed of an elastomer foam. The top section preferably contains a relatively rigid foam to facilitate grasping of the top section to handle the applicator. The top section may contain a closed cell foam or microcell foam. In one embodiment, the top section is made of a crosslinked polyethylene foam. In another embodiment, the top section is made of a metallocene polyolefin foam. The bottom section may be made of a urethane foam.

The body preferably contains a curved portion having an ergonomic shape to facilitate grasping of the body and to reduce the fatigue experienced by the user during polishing. The curved ergonomic portion may be sized to receive the thumb and/or fingers of a user.

Compressible material contained in the bottom section may act as a sponge to absorb and store a lubricating agent. The compressible material is preferably adapted to dispense a selected amount of stored liquid lubricating agent upon being compressed. The amount of liquid lubricating agent dispensed is preferably proportional to the degree to which the second compressible material is compressed during polishing. The top section of the applicator is preferably substantially impermeable to liquid lubricating agents to shield the user from such agents.

The applicator preferably has a density that allows it to float on water when the plastic flexible tool is disposed within the cavity.

The bottom section preferably includes a bottom surface about a perimeter of the cavity that contacts the surface when the applicator is reciprocated during polishing. The cavity preferably has a sufficient depth to contain the plastic flexible tool recessed within the cavity with respect to the bottom surface. The applicator body preferably covers at least about half of the surface area of the plastic flexible tool when it is disposed within the cavity. The bottom section may be compressed to cause the plastic flexible tool to become substantially flush with the bottom surface during use to allow the tool to contact the surface to be polished.

The tool may include a plurality of particles dispersed throughout the plastic flexible material that knead the plastic flexible material when the tool contacts the surface to be polished. The kneading of the plastic flexible material preferably causes plastic flexible material within the interior of the tool to become exposed on the outer surface of the tool. The particles dispersed throughout the plastic flexible material may be styrofoam beads.

The applicator of the present invention may be operated manually or used in combination with a mechanical polisher or sander that simulates a hand-polishing motion. The mechanical polisher may be a dual action polisher, an orbital polisher, or an ocillating polisher. The mechanical applicator may contain a body having a top portion and a bottom portion. The mechanical applicator may contain an opening in its top portion for engaging an alignment stud located on the mechanical polisher.

A VELCRO portion may be attached onto the inner surface of the cavity to provide a site for attachment to a complementary VELCRO mating surface located on the plastic flexible tool. The inner VELCRO portion disposed on the inner surface of the cavity preferably contains hook-type VELCRO for attachment to loop-type VELCRO contained on the mating surface of the polishing tool.

A VELCRO portion is preferably attached to the top portion of the mechanical applicator to connect the applicator to the mechanical polisher via a complementary VELCRO portion contained on the mechanical polisher. The VELCRO portion may be connected to the body by glue disposed between the VELCRO portion and the body that makes the body more rigid proximate its top section. The VELCRO portion of the mechanical applicator preferably includes "loop-type" VELCRO for attachment to "hook-type" VELCRO contained on the mating surface of the mechanical applicator.

In another embodiment, an applicator which includes a body and a cavity is configured to allow a variety of polishing tools to be inserted within the cavity. The body is preferably made of a flexible or compressible material such as a foam. Force may be applied to the applicator to move the applicator and a polishing tool disposed within the applicator across a surface to be polished, thereby causing the polishing tool to exert a polishing force on the surface.

The inner surface of the cavity preferably contains a portion of a hook-loop fastening system for attachment to a complementary portion of a hook-loop fastening system located on a polishing tool. For example, a hook portion of a hook-loop fastening system may be attached to the inner surface of the cavity. A polishing tool may be attached to a loop portion of a hook-loop fastening system. The polishing tool may then be fastened to the applicator by coupling the hook portion residing in the cavity with the loop portion residing on the polishing tool. In this manner, the polishing tool may be easily removed and replaced with other polishing tools. In an alternate embodiment, a loop portion of a hook-loop system may be attached to the inner surface of the cavity and a hook portion of a hook-loop system may be attached to a polishing tool.

The body may absorb a polishing compound and selectively disperse the polishing compound to the surface to be polished. A polishing compound as used herein is defined as a compound used to polish a surface. The body preferably acts as a sponge to store and dispense the polishing compound during polishing. Compressing the applicator to a selected degree preferably causes the dispersal of a selected amount of polishing compound from the body of the applicator.

A variety of polishing tools may be positioned within the cavity of the applicator. The polishing tools are preferably shaped to fit within the cavity. Examples of polishing tools include a plastic flexible tool, a wool pad, a foam pad, and a sanding pad.

A cavitied foam pad may also be used as a polishing tool. The cavitied foam pad may be a polymeric foam material. The cavitied foam pad has a number of cavities formed within an upper surface of the foam pad. The cavities preferably extend into the foam pad from a depth of about 0.015 inch to up to about the width of the pad, but not extending through the pad. The number of cavities formed within the foam pad may be dependent on the size of the cavities. Generally, the area occupied by a cavity ranges from about 0.05 square inch to about 1 square inch. When cavities having an area of about 0.05 square inches are formed in a foam pad having a diameter of about 4 inches from about 10 to about 50 cavities may be formed within the foam pad. Additional cavities may be formed on the sides of the foam pad.

The applicator may be connected to a mechanical polisher. The mechanical polisher may be a dual action polisher, an orbital polisher, an oscillating polisher, or any other automatic polisher configured to simulate the motion that characterizes manual polishing. The applicator preferably contains a connecting portion on its top surface for attachment to a mechanical polisher.

In an other embodiment the connecting portion may be used to connect the applicator to a handle. The handle is preferably attached to a connecting disk. The connecting disk is preferably made of a relatively rigid microcell foam or closed cell foam. The handle is preferably secured to the connecting disk by gluing or sewing. The handle may be made of a flexible material, the material being sufficiently flexible to expand when a hand is inserted between the handle and the connecting disk. The handle preferably applies a force upon a hand inserted between the handle and the disk such that the hand is secured to the connecting disk. The connecting disk is preferably attached to a portion of a hook-loop system. The applicator may be fastened to the connecting disk of the handle by coupling the portion of the hook-loop fastening system residing on the applicator with a complimentary portion residing on the connecting disk. In this manner, the applicator may be easily attached and removed from the handle.

In an embodiment of the applicator the body includes a top section and a bottom section. The top and bottom sections may be glued together or connected via a pressure sensitive adhesive. The bottom section is preferably made of a compressible or flexible material, and the top and bottom sections may have different compressibilities and/or flexibilities. The top section is preferably more rigid and/or less compressible than the bottom section.

The lower surface of the top section and the bottom section together form the cavity of the applicator. The lower surface of the applicator preferably is configured to have a polishing tool removably attached to the lower surface. Preferably a portion of a hook-loop fastening system is attached to the lower surface. The portion of the hook-loop system is configured for attachment to a complementary portion of a hook-loop fastening system located on a polishing tool. The use of a hook-loop system may allow a variety of polishing tools to be removably attached to the applicator.

In another embodiment, an applicator may be constructed with a liner inserted within the cavity. The liner is preferably made of a foam. The liner is preferably attached to the inner surface of the cavity. The liner is preferably glued to the inner surface or connected via a pressure-sensitive adhesive. A polishing tool may be attached to the liner. Preferably a portion of a hook-loop fastening system is attached to the liner. The portion of the hook-loop system is configured for attachment to a complementary portion of a hook-loop fastening system located on a polishing tool. The use of a hook-loop system may allow a variety of polishing tools to be removably attached to the applicator.

Use of a system which includes an applicator and a variety of polishing tools as described above, preferably allows a variety of polishing operations to be accomplished with the same applicator. The applicator is preferably made of a foam body which is particularly suited to absorb lubricating agents, polishes, glazes or other polishing compounds. The applicator may store these compounds and selectively dispense the polishing compounds onto a vehicle surface while it is polished. The applicator may be bundled and presented as a kit having a variety of interchangeable polishing tools all configured to fit within the cavity of the applicator. The polishing tools may include tools for sanding, removal of surface imperfections, compounding, glazing and polishing. When bundled as a kit the system may include all of the necessary tools for the completion of a variety of surface finishing operations. The kit may also include a variety of polishing compounds for the various polishing operations.

The polishing of a surface may include a variety of polishing operations including, but not limited to sanding, removal of surface imperfections, compounding, glazing and polishing. Typically, each of these operations may require the use of a separate polishing tool. The use of an applicator with interchangable polishing tools, as described above, allows a variety of these polishing operations to be accomplished by simply interchanging the polishing tools.

DETAILED DESCRIPTION OF PREFERRED EMBODIMENTS

A method of the invention may include covering at least a portion of a human hand with a plastic film, determining the location of a stain or protrusion on the surface by touching the surface with at least a portion of the covered human hand, wherein plastic film is between the portion of the human hand and the surface while the surface is being touched; applying a plastic flexible tool to the stain or protrusion, the plastic flexible tool comprising a plastic flexible material having an abrasive mixed therewith; and applying a force to the plastic flexible tool such that a polishing force is applied by the plastic flexible tool to the stain or protrusion on the surface.

Figure 1:
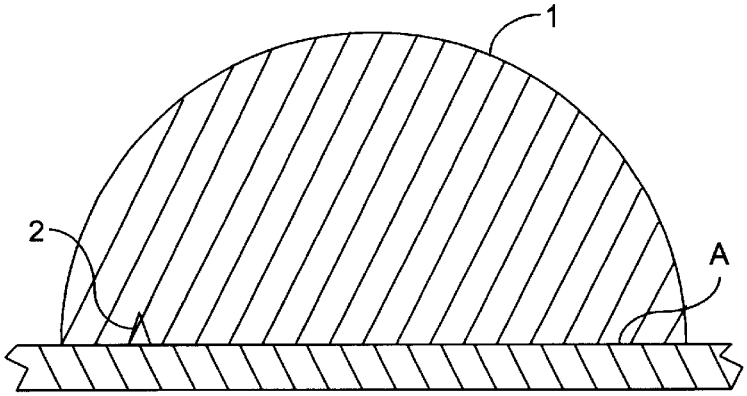
FIG. 1 is an explanatory figure showing a plastic flexible tool in use.
Figure 4:
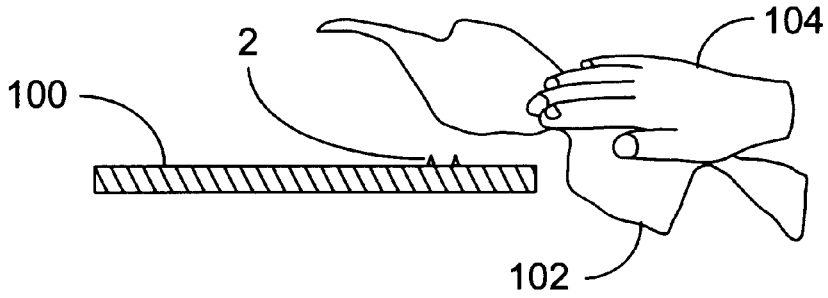
FIG. 4 depicts use of a plastic film.

FIG. 1 depicts a plastic flexible tool 1 applied to a surface with a protrusion 2. FIG. 4 depicts a surface 100 with a protrusion 2. In FIG. 4 a portion of the human hand 104 is covered by the plastic film 102 such that the plastic film 102 is between the human hand 104 and the surface 100.

Figure 5:
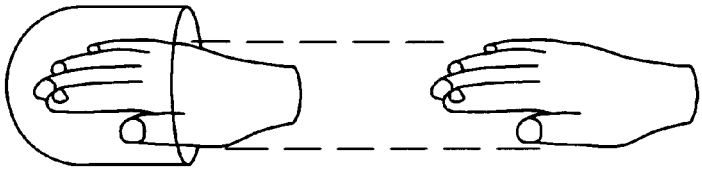
FIGS. 5–8 depict various embodiments of a plastic film.
Figure 6:
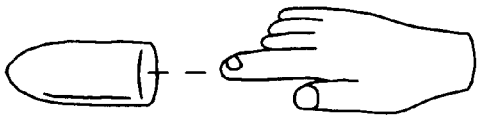
Figure 7:
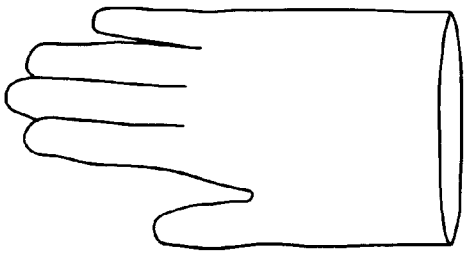
Figure 8:
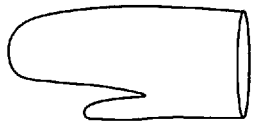

The plastic film preferably covers at least a portion of a human finger. In this context, "covers" means that the plastic film is between the surface to be touched and the portion of the human hand touching the surface. The plastic film may be in the following shapes: flat and/or substantially planar (see FIG. 4), glove (see FIG. 7), mitten (see FIG. 8), envelope, sleeve, or bowl (see FIG. 5), or finger cot (see FIG. 6).

Figure 9:
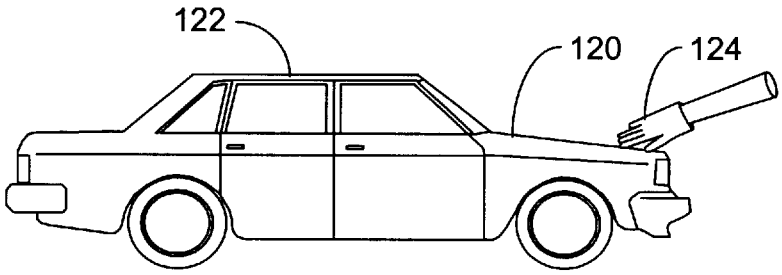
FIG. 9 depicts application of a plastic film onto an exterior surface of an automobile.

The surface may be the surface of a vehicle such as an automobile, motorcycle, boat, truck, plane, or train. The surface may be coated or painted. FIG. 9 depicts an automobile 122 with a surface 120 being touched with a human hand within a glove 124.

The ability of the human hand to feel a stain or protrusion on the surface is enhanced by the plastic film. The plastic film tends to exaggerate and accent the sense of touch when feeling such stains or protrusions. It is believed that the ability of the plastic film to exaggerate and accent the sense of touch is a function of the thickness and modulus of elasticity for the film.

The plastic film is preferably not too thin or too thick. If the film is too thin, then its efficacy, strength and durability may be reduced. If the film is too thick, then the sense of touch may be reduced. Preferably the plastic film is less than about 1.0 mm thick, more preferably between about 0.1 mm and less than about 0.75 mm thick, and more preferably still at 0.5 mm thickness. The plastic film is preferably sufficiently thin such that tactile sensitivity of the covered portion of the human hand to a surface protrusion is increased.

The plastic film is also preferably not too elastic or inelastic. Preferably the plastic film has a modulus of elasticity according to ASTM test D-882, Method A, within the range of 50,000 to 120,000 psi at 73° F., and more preferably in the range of 60,000 to 100,000 psi at 73° F.

The plastic film is preferably substantially transparent. In this manner the practitioner can see the area in which poorly visible protrusions are located by feel. The plastic film may include a polyolefin, polystyrene, parafilm, and polyethylene. The plastic film may include elastomer material and/or an acrylic or methacrylic material.

In one embodiment, Cryovac MPD 2055 50 gauge Shrink Film (available from Innovative Packaging Inc. located in Grand Prairie, Tex., or Cryovac located in Iowa Park, Tex.) was used as the plastic film described above. In addition, Cryovac MPD 2100 50 gauge Shrink Film may also be used. Plastic film mittens that preferably have the following dimensions may be used: 4 and ¼" wide by 3", plus a ¼" lip on the edge of the mittens.

One method may include checking the amount of removal of the stain or protrusion on the surface after the flexible plastic tool has been applied. The checking may be accomplished by touching at least a portion of a covered human hand onto the surface, wherein plastic film is between the portion of the human hand and the surface while the surface is being touched.

One method may include pressing the plastic flexible tool against the surface, thereby deforming the plastic flexible tool to form a substantially flat surface on the plastic flexible tool. The plastic flexible tool may preferably be pressed against the surface such that the protrusion substantially embeds itself into the substantially flat surface of the plastic flexible tool. One preferred method includes reciprocating the substantially flat surface of the plastic flexible tool on the surface such that the protrusion protrudes into the plastic flexible tool and is brought into contact with abrasive inside the plastic flexible tool. Preferably the abrasive is substantially buried inside the plastic flexible tool such that the abrasive does not substantially protrude from the substantially flat surface of the plastic flexible tool.

Preferably the surface is not forcefully contacted with abrasive. Preferably the amount of force applied to the surface is about 1/30 to 1/200 (or, more preferably still, 1/80 to 1/100) of the amount of force applied to the protrusion. In one embodiment about 0.5 to 3.0 percent of force applied to the protrusion is substantially simultaneously applied to the surface.

A lubricant and/or water may be added to the surface such that the lubricant and/or water is between the plastic flexible tool and the surface while the plastic flexible tool is being applied to the surface. The lubricant may include CLAY MAGIC #49 Body Shine or BODY MAGIC LUBRI-SHINE (Auto Wax Company, Inc., Dallas, Tex.).

Preferably the stain or protrusion is removed from the surface without substantially scratching the surface.

The plastic flexible tool is preferably made by substantially homogeneously mixing the abrasive with a plastic flexible material.

Figure 10A:
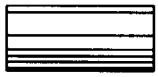
FIGS. 10A–10F depict various shapes of a plastic flexible tool.
Figure 10B:
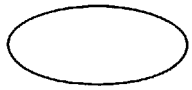
Figure 10C:
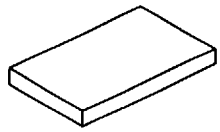
Figure 10D:
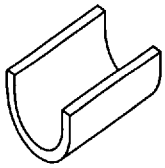
Figure 10E:
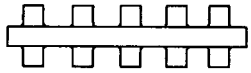
Figure 10F:
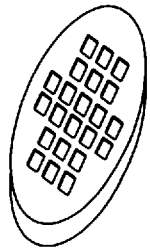

FIGS. 10A–10F depict various shapes in which the plastic flexible tool may be formed. For example, the flexible tool may be in the shape of a bar (FIG. 10A), an oval (FIG. 10B), a flat plane (FIG. 10C), a bent plane (FIG. 10D), a flat plane with raised portions (FIG. 10E), or a "waffle" (FIG. 10F). The plastic flexible tool may become contaminated with dirt during use. Some of the above-referenced shapes tend to maximize the amount of clean surface area available for a certain tool volume.

A plastic flexible tool may be produced by mixing 100 parts by weight of a petroleum resin (e.g., polybutene) as a plastic flexible material with 65 parts by weight of fine silica sand and calcium carbonate grains from 20 to 30 $\mu$m in diameter, and, optionally, 5 parts by weight of a powder synthetic detergent composed of grains 500 $\mu$m in diameter.

Figure 2:
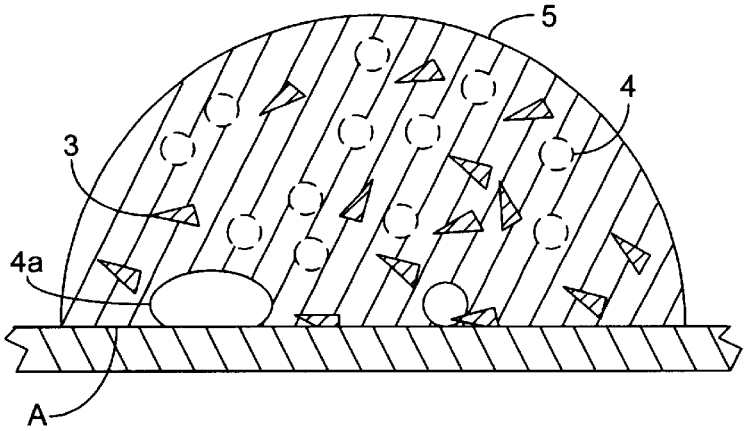
FIG. 2 is a cross sectional view of a plastic flexible tool with the abrasive thereof forming protrusions against the polishing surface.

Referring to FIG. 1, the flexible tool 1 above may be used for removing a small protrusion 2 (e.g., a protrusion 0.5 mm in height and 1 mm in width) from the coated planar surface A. First, the protrusion may be located and/or detected by touching the surface with a portion of a human hand covered with a plastic film. Once the protrusion is located, the flexible tool may be pressed against coated planar surface A to form a flat plane on the flexible tool. Fine abrasive 3 and, optionally, powder synthetic detergent 4 may be distributed within a flexible material 5 as shown in FIG. 2. By reciprocating the planar surface of the flexible tool I on the coated planar surface A having the protrusion 2 thereon, the protrusion 2 may be removed completely from the coated planar surface A in a relatively small time period (e.g., about 30 seconds). A stain on the coated planar surface may be removed at the same time. A coated surface as plain and smooth as the surface before polishing may be obtained free from scratches and flaws by the polishing operation.

Referring again to FIG. 2, in one embodiment a pore 4*a* can be seen to open on the surface in contact with the coated planar surface A, due to the dissolution of the powder synthetic detergent 4. The open pore 4*a* tends to facilitate sticking of the fine abrasive against the polishing surface. In this manner, the polishing speed of the planar surface may be accelerated.

Hard fine grains such as alumina, ceramics, and/or Green Carborundum may be incorporated in the flexible material as the fine abrasive 3. These grains may be in addition to or replace the aforementioned grains of silica sand and calcium carbonate. Any of the above-mentioned abrasives may be used either alone or as a mixture of two or more selected therefrom. The fine abrasive grains are preferably confined to a diameter in the range of 20 to 30 $\mu$m, but the size may also be within a range of from about 3 to about 50 $\mu$m depending on the object of polishing. The amount of fine abrasive may be varied within a range of from about 60 to 80 parts by weight with respect to 100 parts weight of plastic flexible material.

In removing small protrusions from the coated surface using the plastic flexible tool according to the present invention, the plastic flexible tool is preferably pressed against a flat and hard plane to form a flat surface on the plastic flexible tool. At this stage, the fine abrasive may be buried inside the flat surface of the plastic flexible tool to leave no edges thereof sticking out from the flat surface of the plastic flexible tool.

When the flat surface of the plastic flexible tool is placed over a small protrusion on the coated surface, the small protrusion tends to bore a small hole on the flat surface of the plastic flexible tool and accommodate itself therein. This tendency is illustrated in FIG. 1. When the flexible tool is repeatedly reciprocated on the coated surface along the direction indicated by the arrows shown in FIG. 1, the flat surface of the plastic flexible tool moves with its surface being cut with the small protrusion. Since the fine abrasive is not pressed uniformly by the small protrusion, the edges of the fine abrasive stick out from the flexible material.

Accordingly, the fine abrasive sticking out from the flexible material may be brought forcibly into contact with the small protrusion to conduct polishing. The flat surface formed on the flexible tool is also brought into contact with the coated surface in this case, however, the coated surface suffers little or no scratches or flaws because the edges of the fine abrasive do not stick out from the flat surface of the flexible material.

Figure 3A:
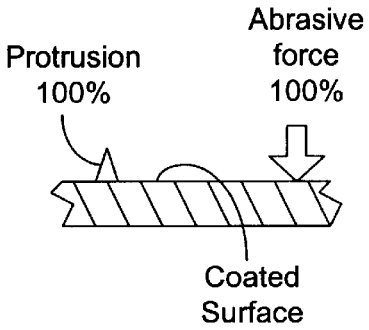
FIG. 3 is a schematic figure provided as an explanatory means to show the exertion of polishing force against the protrusions and stain.
Figure 3B:
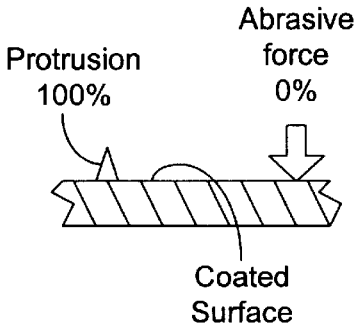
Figure 3C:
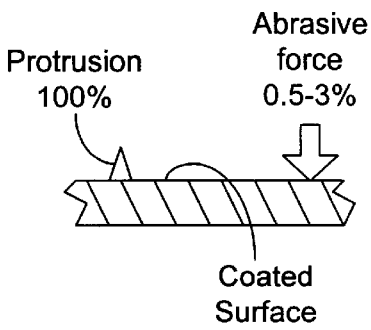

Water may be sprayed to the region on which the flexible tool is moved or to the flexible tool. The powder detergent, if any, incorporated into the flexible tool may then dissolve into the water to allow the fine abrasive to be exposed on the surface. The amount of the exposed fine abrasive can be controlled by the amount of powder detergent being incorporated into the flexible tool. The fine abrasive grains sticking out from the polishing surface immediately slip into the flexible material upon detection of a resistance on the polishing surface. In this manner, the polishing force against the flat surface may be about 1/80 to 1/100 of the force applied to a protrusion. Force is thus applied to both the protrusion and the surface stain when polishing is conducted as shown in FIG. 3(*c*). Specifically, about 0.5 to 3% of a polishing force may be applied to the stain with respect to 100% of the force applied to the protrusion.

The polishing ability against a flat surface may be controlled in the range of from 1/30 to 1/200 of the force applied to a protrusion.

In removing both the protrusion and the stain from a coated surface, it is preferred that the protrusion and the stain are removed within a same duration of time, or the protrusion is removed faster than the stain. It is not desirable to have the stain be removed faster than the protrusion, because the polishing marks of the protrusion may remain on the coated surface.

The plastic flexible tool according to the present invention may include a flexible material having mixed therewith fine abrasive and powder synthetic detergent. Accordingly, the flexible tool according to the present invention is capable of removing small protrusions and stains from the surface without impairing a flat or curved plane of a coated surface. This removal is accomplished by maintaining a uniform surface against the area to be polished. Furthermore, the plastic flexible tool tends to facilitate rapid operation because it can be worked with a small frictional force. A plastic flexible tool may be available from Auto Wax Company, Inc. (Dallas, Tex.), Joybond Co., Inc. (Tokyo, Japan), Auto Chemie Co., Ltd. (Tokyo, Japan), Honda Motor Co. (Tokyo, Japan) or Nissan Motor Co. (Tokyo, Japan). Auto Wax Company, Inc. sells a plastic flexible tool under the "Clay Magic" tradename.

Figure 11:
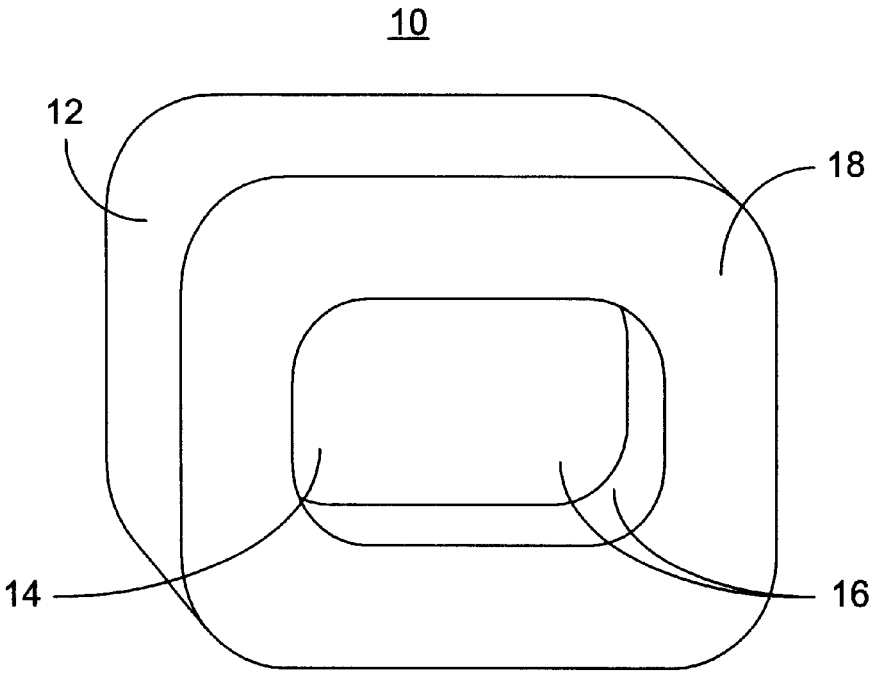
FIG. 11 depicts a bottom perspective view of an applicator constructed in accordance with the present invention.

The plastic flexible tool may be disposed within or onto an applicator to facilitate the exertion of a polishing force by the tool onto a surface. A bottom perspective view of an applicator 10 is depicted in FIG. 11. The applicator preferably includes a body 12 having a cavity 14 formed therein. The plastic flexible tool is preferably housed within the cavity. The cavity is preferably defined by an inner surface 16. The body is preferably made of a flexible or compressible material such as a foam. Although the body as depicted in FIG. 11 has an oval shape, it is to be understood that the body may be of a number of other shapes including circular, rectangular, etc. Force may be applied to the applicator to move the applicator and plastic flexible tool disposed within the applicator across a surface to be polished, thereby causing the plastic flexible tool to exert a polishing force on the surface.

Figure 17A:
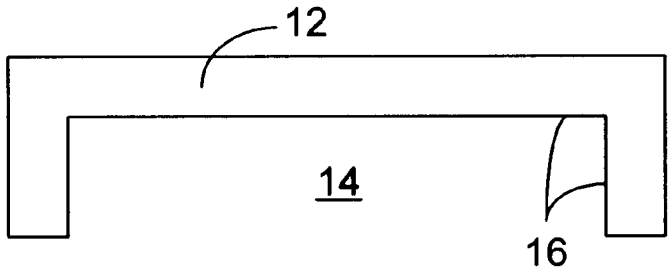
FIGS. 17A–17D depict various embodiments of an applicator cavity.
Figure 17B:
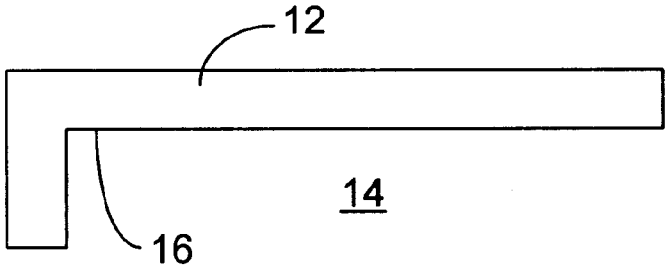
Figure 17C:
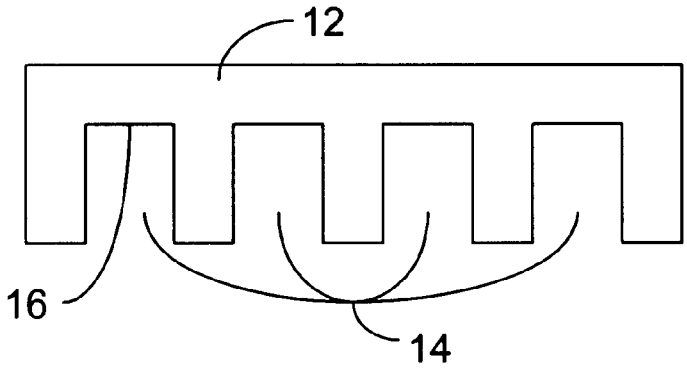
Figure 17D:
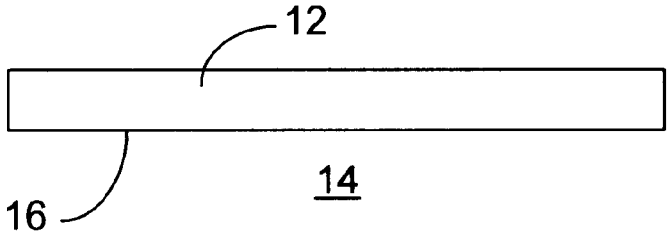

For the purpose of this description, "cavity" is taken to mean a site proximate the body of the applicator where the plastic flexible tool is disposed. The cavity 14 may be a region indented into body 12 that is partially enclosed by the body as depicted in FIG. 17A and FIG. 17B. As depicted in FIG. 17C, the cavity may include more than one indention within which at least a portion of the plastic flexible tool is disposed. It is also to be understood that cavity 14 may be a substantially unenclosed region of space proximate the bottom of the applicator body. A cavity formed on the planar surface of the applicator is depicted in FIG. 17D. The cavity 14 in FIG. 17D may be altered during polishing when the plastic flexible tool exerts a force against the body, thereby deforming the body and embedding itself into inner surface 16. Alternately, the inner surface 16 may be sufficiently rigid so as to remain substantially undeformed during polishing such that the entire tool protrudes from the body. It is generally preferred, however that at least a portion of the plastic flexible tool be recessed within the body to maintain the tool within cavity 14.

Figure 14:
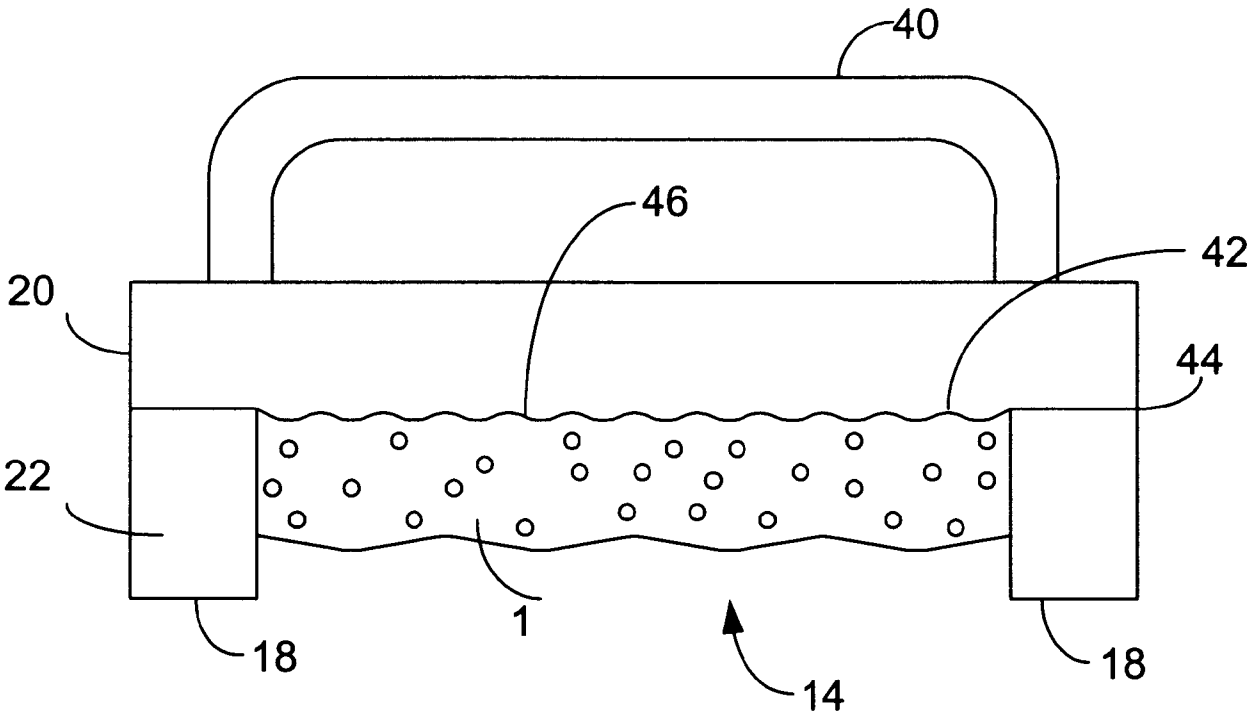
FIG. 14 depicts a cross sectional view of an applicator having a plastic flexible tool disposed within its cavity.

The applicator 10 is preferably attachable to the plastic flexible tool to form a fixable engagement. The plastic flexible tool may adhere to the inner surface of the cavity. The inner surface may be serrated and/or contain convolutions 42 (as shown in FIG. 14) to increase adhesion between the inner surface and the plastic flexible tool. The adhesion between the inner surface and the plastic flexible tool is preferably sufficient to maintain a fixable engagement between the tool and the inner surface when the tool and applicator are reciprocated across a surface to polish it. The inner surface of the cavity is preferably characterized by an adhesivity or "stickiness" that causes it to adhere to the plastic flexible tool. Alternately, the inner surface of the cavity may be coated with an adhesive that allows the plastic flexible tool to be removably attached to the inner surface. The plastic flexible tool is preferably able to be repeatedly inserted into and removed from the cavity without a substantial lessening of adhesive strength between the tool and the inner surface. In an alternate embodiment, the plastic flexible tool may be glued to the inner surface. It is generally preferred, however that the plastic flexible tool be removably engaged with the applicator.

In an alternate embodiment, the inner surface 16 contains a VELCRO portion 31 (shown in FIG. 13) for attachment to a complementary VELCRO mating surface located on the plastic flexible tool. In this manner, the plastic flexible tool may be easily removed and replaced if it becomes excessively dirty or aged. The VELCRO portion may be attached to the inner surface by a glue or a pressure-sensitive adhesive. The VELCRO portion on the inner surface preferably contains "hook-type" VELCRO for attachment to "loop-type" VELCRO contained on the mating surface of the plastic flexible tool. "Hook-type" VELCRO is taken to mean an aggressive VELCRO mating section having relatively large attachment elements (i.e., hooks) as compared to those attachment elements (i.e., loops) of a complementary "loop-type" VELCRO section.

Figure 12:
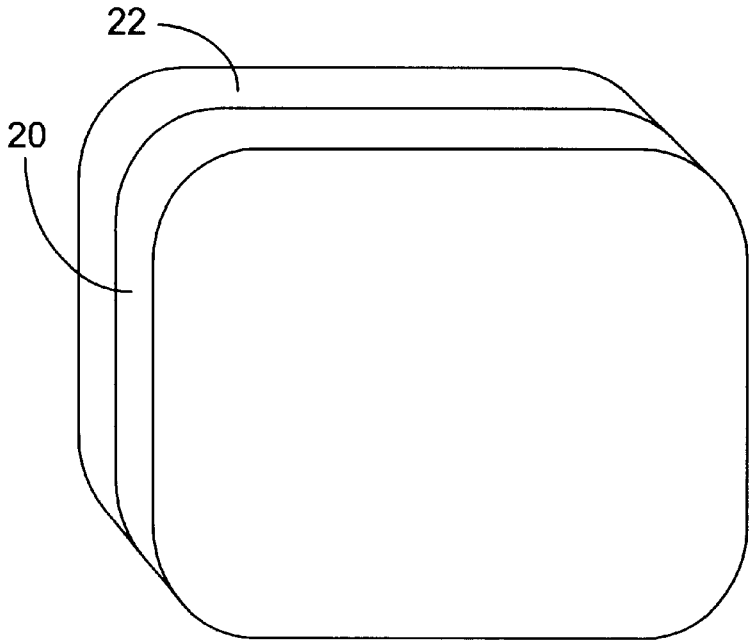
FIG. 12 depicts a top perspective view of an applicator constructed in accordance with the present invention.

A perspective top view of the applicator is depicted in FIG. 12. In an embodiment of the invention, the body comprises a top section 20 and a bottom section 22. The top and bottom sections may be glued together or connected via a pressure-sensitive adhesive. The bottom section is preferably made of compressible or flexible material, and the top and bottom sections may have different compressibilities and/or flexibilities. The top section is preferably more rigid and/or less compressible than the bottom section. It is to be understood that the top section may be substantially compressible and/or flexible, however it is generally preferred that it be at least slightly more rigid than the bottom section. Alternately, the top section may be constructed of a substantially rigid material such as a plastic. The bottom section may have a thickness that is greater than that of the top section.

In an embodiment, the top section of the applicator is made of a plastomer and the bottom section is made of an elastomer. The plastomer may be manufactured from a resin having a specific gravity of at least about 0.89, whereas the elastomer may be manufactured from a resin having a specific gravity of less than about 0.89. The elastomer tends to be relatively soft and more capable of stretching as compared to the plastomer.

The top section is preferably made of a relatively rigid microcell foam or closed-cell foam, while the bottom section is preferably made of an open cell foam. In one embodiment, the top section contains a polyethylene foam (preferably crosslinked) or another polyolefin foam (preferably formed with a metallocene catalyst). It has been found that a top section constructed of foam MC SSP-20-NE or foam MC 1900-EVA, each of which is commercially available from Buff and Shine Performance Products located in Rancho Domingues, Calif. performs adequately in the applicator of the present invention. The top section may have a density of about 1.6 to 2 pounds per cubic foot. It has also been found that 100-30 urethane, also commercially available from Buff and Shine Performance Products located in Rancho Domingues, Calif., performs adequately as a material of construction of the bottom section of the applicator.

The material of construction and rigidity of the bottom section of the applicator should be chosen according to the surface to be polished. The pores per inch of a given foam may be used as an indicator of the "aggressiveness" of the foam. More aggressive foams (i.e., those having a relatively low number of pores per inch) tend to be more suitable for polishing surfaces that can withstand or require relatively harsh treatment. Generally, the bottom section should contain a less aggressive foam having a relatively high number of pores per inch when a newly painted surface is to be polished. Foams having a relatively high number of pores per inch also generally tend to absorb liquid lubricating agents more readily than foams having fewer pores per inch, other things being equal. The bottom section is preferably made of a foam having between about 60 pores per inch and about 150 pores per inch, more preferably between about 75 pores per inch and about 125 pores per inch, and more preferably still between about 90 pores per inch and about 110 pores per inch.

The top section is preferably relatively rigid to facilitate grasping and handling of the applicator. The bottom section is preferably relatively compressible to allow the depth of cavity 14 to be altered during use. The thickness of the plastic flexible tool is preferably less than the depth of the cavity, and the plastic flexible tool is preferably disposed within the cavity such that the tool is recessed within the cavity with respect to the bottom surface 18. With the tool recessed within the cavity, the applicator could be set on a surface whereby the bottom surface 18 engages the surface without contact occurring between the plastic flexible tool and the surface. In this manner, contact between a surface and the plastic flexible tool when the tool is not in use may be avoided. Such contact could contaminate the plastic flexible tool or allow sticking between the surface and the tool. The bottom section may be compressed by the application of a force to the top section, causing a decrease in the depth of the cavity such that the plastic flexible tool becomes flush with or extends beyond the bottom surface 18 to allow contact between the tool and the surface to be polished.

The bottom surface 18 preferably engages the surface that is polished during use and preferably is sufficiently soft so as not to mark or scratch the surface during reciprocation of the applicator across the surface.

In an embodiment, the bottom section absorbs a lubricant agent or water and selectively disperses the lubricating agent or water to the surface to be polished. The lubricating agent or water may be applied to the surface or directly to the applicator. The bottom surface preferably acts as a sponge to store and dispense lubricating agent or water during polishing. Compressing the bottom surface of the applicator to a selected degree preferably causes the dispersal of a selected amount of lubricating agent or water from the applicator. The top section is preferably impermeable to lubricating agents and/or water to inhibit such agents from passing through the applicator and contacting the user.

Figure 13:
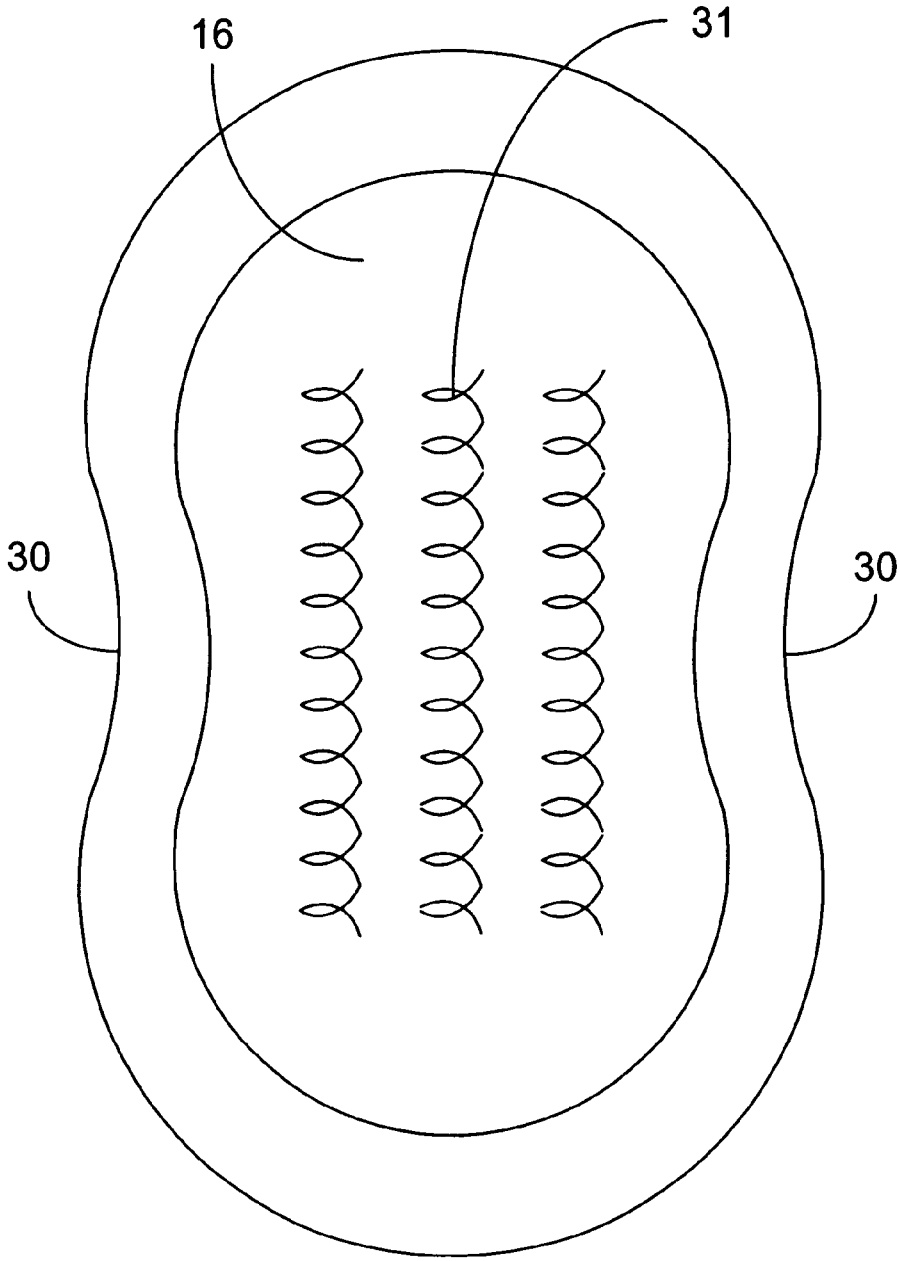
FIG. 13 depicts a bottom view of an ergonomically-shaped applicator constructed in accordance with the present invention.

In an embodiment depicted in FIG. 13, the body contains an ergonomic curved portion 30 to facilitate grasping of the applicator. The curved portion is preferably grasped by the fingers and/or thumb during use. The ergonomic shape of the applicator tends to reduce the fatigue experienced by the user when manually polishing a surface for an extended period of time.

A cross-sectional view taken from the side of an applicator having a plastic flexible tool 1 disposed within cavity 14 is illustrated in FIG. 14. The plastic flexible tool may have a consistency similar to that of clay such that the tool is deformable to assume the shape of the cavity. The lower surface 46 of the top section that contacts bottom section 22 at interface 44 may form a portion of the inner surface of the cavity. The plastic flexible tool is preferably shaped to substantially cover lower surface 46 of the top section. Applicator 10 may contain a handle 40 which may be grasped during polishing to direct the applicator.

The applicator and plastic flexible tool may be used to polish the surface of a vehicle such as a boat. The applicator preferably has a density that enables it and the plastic flexible tool disposed within its cavity to float on water in case that the applicator is accidentally dropped into water during use. The applicator body also preferably covers at least about half of the surface area (e.g., one side of a planar plastic flexible tool) of the plastic flexible tool when the tool is disposed within the cavity during use. In this manner, the likelihood that the plastic flexible tool will be contaminated if the applicator and tool are dropped is reduced.

Applicator 10 may be used in combination with the previously described embodiments. In particular, plastic film 102 may be placed onto a user's hand and used to locate a stain or protrusion or check the amount of stain or protrusion on the surface in the manner described above. The plastic flexible tool may be disposed within the cavity. The applicator is preferably pressed against the surface, causing bottom section 22 to compress and the surface of the plastic flexible tool to become flush with bottom surface 18. The plastic flexible tool preferably engages the surface to form a substantially flat surface on the tool. A force is preferably applied to the applicator to move it, causing the plastic flexible tool to move along the surface while exerting a polishing force on the surface. The applicator is preferably reciprocated across the stain or protrusion until the stain or protrusion is removed.

The applicator may be manually operated in the hand of a user, or alternately may be connected to a mechanical polisher. The mechanical polisher may be a dual action polisher, an orbital polisher, an oscillating polisher, or any other automatic polisher adapted to simulate the motion that characterizes manual polishing. In this description, "polisher" is taken to also include a sander or drill. For instance, the applicator may be fitted onto a sander or drill that serves as a polishing device. An exemplary polisher that has been found to perform adequately in embodiments of the invention is the model 6102 polisher, commercially available from Black & Decker Corp. of Towson, Md.

Figure 15A:
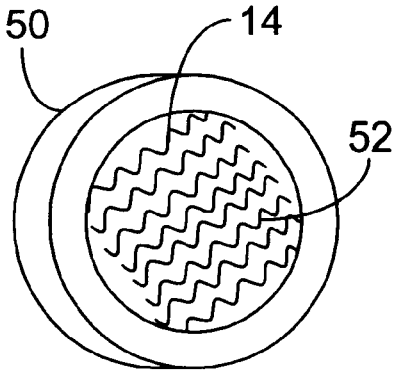
FIGS. 15A–15C depict top and bottom views of an applicator adapted for use with a mechanical polisher and a plastic flexible tool containing a VELCRO mating surface.
Figure 15B:
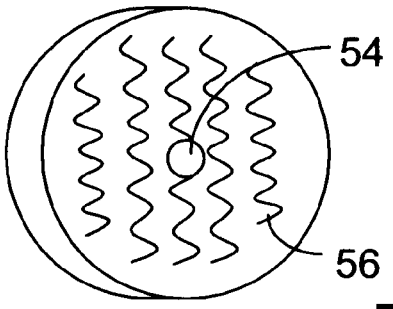

FIG. 15 depicts a mechanical applicator 50 for mechanically polishing the surface. Bottom and top views of applicator 50 are depicted in FIG. 15A and FIG. 15B, respectively. Mechanical applicator 50 may contain any of the features described above in connection with applicator 10.

Figure 15C:
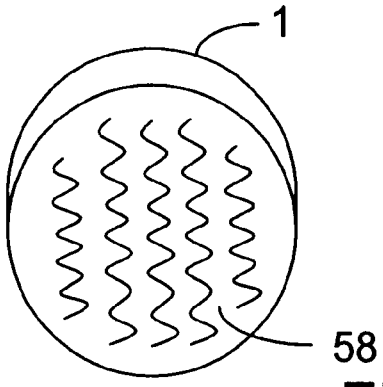

In particular, applicator 50 preferably contains a cavity 14 formed into its bottom surface for accepting flexible plastic tool 1. The cavity may have a depth that is less than or equal to the thickness of the plastic flexible tool, causing the tool to protrude from or be flush with the bottom surface of the applicator. As shown in FIG. 15C, flexible plastic tool 1 may contain VELCRO portion 58 for attachment to VELCRO portion 52, which is disposed on the inner surface of cavity 14. The flexible plastic tool is preferably substantially planar, and VELCRO portion 58 may substantially cover a side of the tool.

The applicator preferably contains a connecting portion on its top surface for attachment to a mechanical applicator. In an embodiment, the connecting portion is a VELCRO portion 56 for connecting the body to a complementary VELCRO mating surface on the mechanical polisher. The VELCRO portion 56 preferably includes "loop-type" VELCRO for attaching to "hook-type VELCRO" contained on the mating surface of the mechanical applicator.

VELCRO portion 56 may be attached to the body of applicator 50 using glue or a pressure-sensitive adhesive disposed between the VELCRO portion and the body. The attachment element (e.g., glue, pressure-sensitive adhesive) may cause the top surface of the applicator to become relatively rigid.

Figure 16:
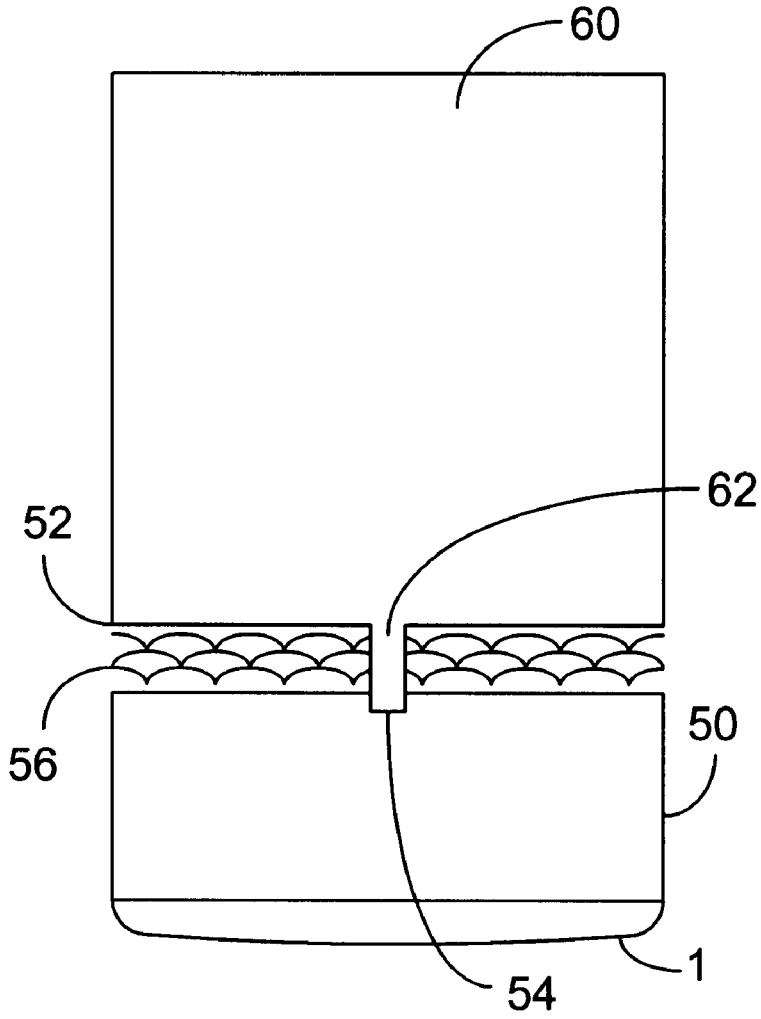
FIG. 16 depicts an applicator secured to a mechanical polisher.

The body of applicator 50 preferably has the shape of a substantially circular disk, and cavity 14 is preferably substantially circular as well. It is to be appreciated that the body may have a variety of shapes depending upon the shape of the mating surface contained on the mechanical polisher. FIG. 16 illustrates the connection of applicator 50 and mechanical polisher 60. The applicator may contain opening 54 in the top portion for engaging a protrusion on the mechanical polisher. The mechanical polisher may contain an alignment stud 62 for insertion into opening 54 to allow the applicator and polisher to be properly connected and centered.

In an embodiment, the plastic flexible tool contains a plurality of particles 48 (as shown in FIG. 14) or beads dispersed throughout the plastic flexible material. The beads are preferably relatively small (e.g., about the size of the head of a pin or less) and may have a number of shapes including a spherical or cubic shape. The particles preferably knead the plastic flexible material to "clean it" when the material is in contact with the surface to be polished. The kneading of the plastic flexible material preferably causes material located within the interior of the tool to become exposed on the outer surface of the tool, and moves material exposed on the outer surface of the tool to the interior of the tool. In this manner, the plastic flexible material may be redistributed about the tool to increase the life of the tool by exposing "fresh" plastic material for contacting the surface. Styrofoam particles have been found to adequately knead the plastic flexible material, however it is to be understood that particles or beads constructed of other materials may be used. The particles may be plastic and are preferably elastomers (e.g., foam). The particles preferably remain embedded within the plastic flexible material during use and do not scratch or mark the surface that is being polished.

The applicator of the present invention preferably provides an ergonomic body to reduce fatigue experienced by the user when grasping the applicator during polishing. In addition, the applicator preferably inhibits contact between the user and the plastic flexible tool during use. The applicator also may increase the rate at which a surface is polished by (a) providing a rigid body to be grasped by the user and (b) increasing the surface area of the plastic flexible tool that engages the surface during polishing. For instance, in the absence of an applicator a planar plastic flexible tool typically must be grasped on each of its sides, thereby reducing the total surface area of the plastic flexible tool available for contacting the vehicle surface. Use of the applicator allows an entire side of the plastic flexible tool to engage the surface during polishing. Moreover, the applicator may be used to store a lubricating agent and selectively dispense the lubricating agent onto a surface while it is polished. The applicator preferably shields the user from contact with the lubricating agent. The applicator may be used manually or adapted for use with mechanical polishers.

Further Improvements

Figure 18A:
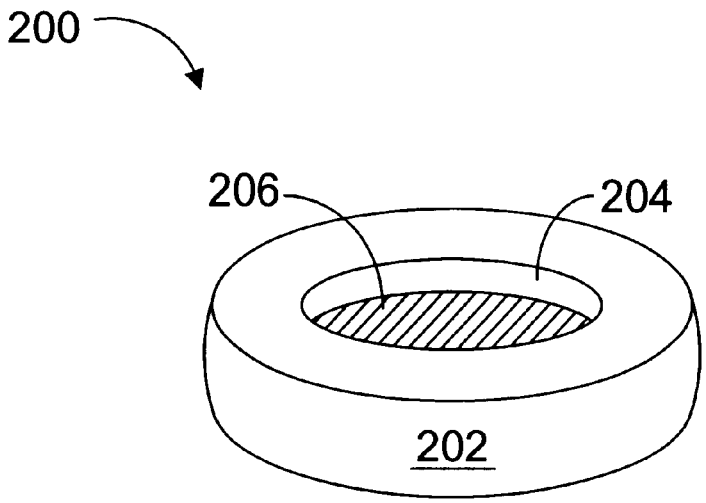
FIGS. 18A and 18B depict an applicator which contains a portion of a hook-loop fastening system within a cavity.
Figure 18B:
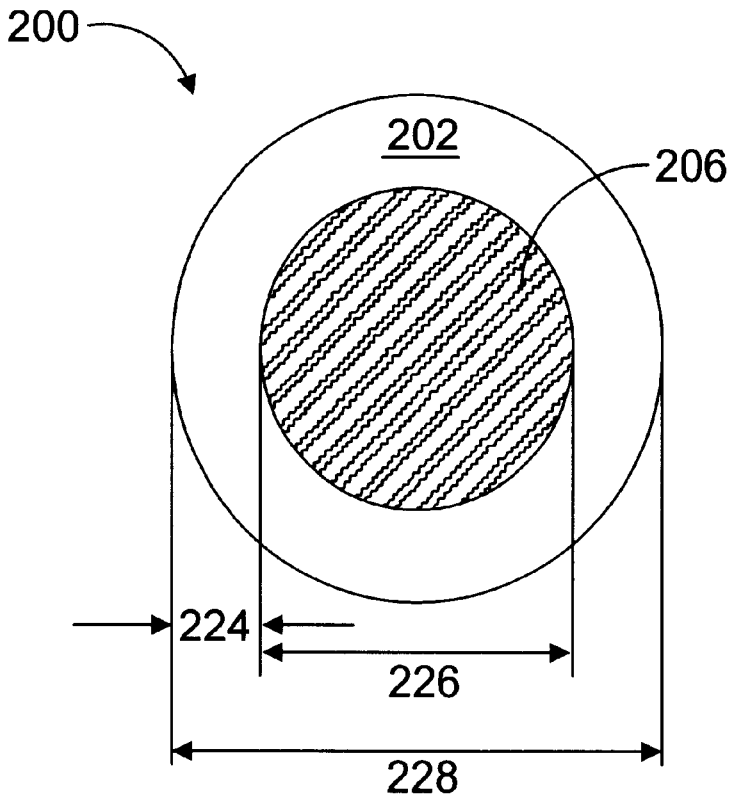

An applicator 200 which may allow a variety of polishing tools to be inserted within a cavity 204 of the applicator is depicted in FIG. 18A. A top perspective view of the applicator 200 is depicted in FIG. 18B. The applicator preferably includes a body 202 having a cavity 204 formed therein. A polishing tool is preferably housed within the cavity. The cavity 204 is preferably defined by an inner surface 206. The body is preferably made of a flexible or compressible material such as a foam. Although the body as depicted in FIG. 18A and FIG. 18B has a circular shape, it is to be understood that the body may be of a number of other shapes including oval, rectangular, etc. Force may be applied to the applicator to move the applicator and a polishing tool disposed within the applicator across a surface to be polished, thereby causing the polishing tool to exert a polishing force on the surface.

The inner surface 206 of cavity 204 is preferably characterized by an adhesivity or "stickiness" that causes it to adhere to the polishing tool. Alternately, the inner surface 206 of the cavity 204 may be coated with an adhesive that allows the polishing tool to be removably attached to the inner surface. The polishing tool is preferably able to be repeatedly inserted into and removed from the cavity without a substantial lessening of adhesive strength between the tool and the inner surface.

In an embodiment the polishing tool may be affixed to the inner surface 206 of the cavity 204. This fixable arrangement may be achieved by the use of glue, a hot melt procedure, or a pressure sensitive adhesive. A variety of polishing tools may be affixed in this manner including but not limited to a wool pad, foam pad, and a sanding pad. When a variety of polishing operations are needed a series of applicators with a different tool affixed within each applicator may be used to accomplish these operations.

Figure 19:
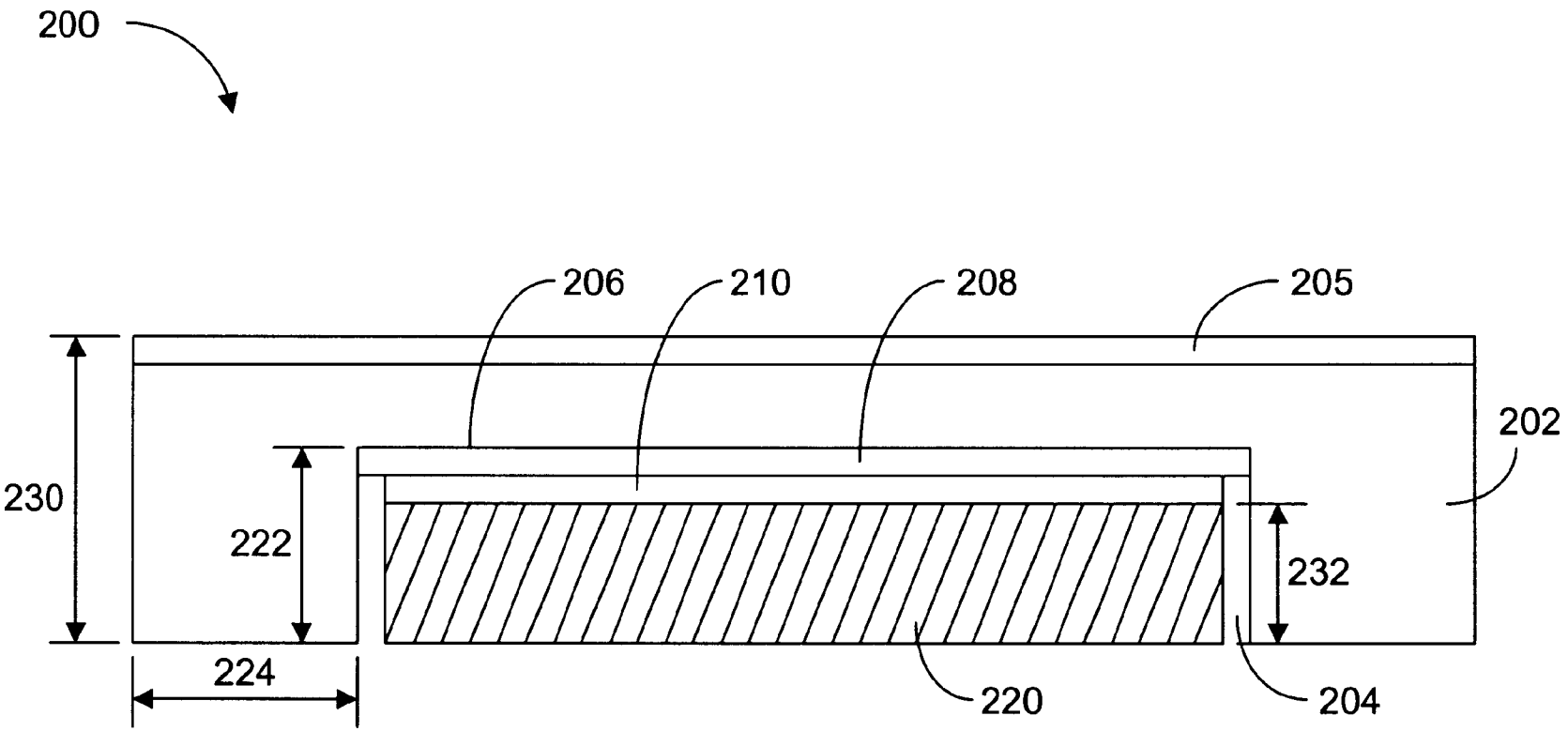
FIG. 19 depicts a cross-sectional view of an applicator with a polishing tool positioned within the cavity.

In an alternate embodiment, the inner surface 206 of the cavity 204 preferably contains a portion of a hook-loop fastening system 208, as shown in FIG. 19, for attachment to a complementary portion of a hook-loop fastening system 210 located on a polishing tool 220. A portion of a hook-loop fastening system may be attached to inner surface 206 of cavity 204 by a glue or a pressure-sensitive adhesive. A hook portion of a hook-loop system is taken to mean a section having relatively large attachment elements (i.e., hooks) as compared to those attachment elements (i.e., loops) of a complementary loop portion of a hook-loop system.

In an embodiment, a hook portion 208 of a hook-loop fastening system may be attached to the inner surface 206 of the cavity 204. A polishing tool 220 may be attached to a loop portion 210 of a hook-loop fastening system. The polishing tool 220 may then be fastened to the applicator 200 by coupling the hook portion 208 residing in the cavity 204 with the loop portion 210 residing on the polishing tool 220. In this manner, the polishing tool may be easily removed and replaced with other polishing tools. In an alternate embodiment, a loop portion of a hook-loop system may be attached to the inner surface 206 of the cavity 204 and a hook portion of a hook-loop system may be attached to a polishing tool 220.

The body 202 is preferably made of a polymeric foam material. Preferably the body 202 is made of a polyurethane foam. The body is preferably made of a foam having between about 60 pores per inch to about 150 pores per inch. More preferably, the body is made of a foam having about 60 pores per inch. The body is preferably made of a foam that is sufficiently soft so as not to mark or scratch the surface during reciprocation of the applicator across the surface.

In an embodiment, the body may absorb a polishing compound and selectively disperse the polishing compound to the surface to be polished. A polishing compound as used herein is defined as a compound used to polish a surface. Examples of polishing compounds include, but are not limited to lubricants, rubbing compounds, glazes, polishes and waxes. The polishing compound may be applied to the surface or directly to the applicator. The body preferably acts as a sponge to store and dispense the polishing compound during polishing. Compressing the applicator to a selected degree preferably causes the dispersal of a selected amount of polishing compound from the body of the applicator.

The body preferably has a circular shape as depicted in FIG. 18B. The cavity is preferably formed in the center of the body. The width of the body 224, extending from an edge of the body to an edge of the cavity may be from about 0.25 inches to about 2 inches, preferably from about 0.5 inches to 1.5 inches, more preferably still about 1 inch. The width of the internal cavity 226 may be about 2 inches to about 8 inches, preferably the width is about 4 to 6 inches. The width of the body 228 may be varied depending on the use of the system. For example, when used in a mechanical polisher the width of the body is preferably substantially equal to a width of the mechanical polisher. Typically, mechanical polishers have a width from about 6 to about 9 inches in diameter. The body, therefore, preferably has a width of about 6 inches to about 9 inches when used with a mechanical polisher. For hand application the body is preferably sized to be easily controlled by hand. The body may have a width from about 4 inches to about 9 inches. Preferably the body has width of about 6 inches. As depicted in FIG. 19 the body may have a thickness 230 of about 0.5 inch to about 2 inch, preferably the thickness 230 is about 1 inch.

A variety of polishing tools may be positioned within the cavity 204 of the applicator. The polishing tools may be used to accomplish a number of finishing operations. Separate polishing tools are typically used for operations such as (1) sanding the surface to remove imperfections and to level the painted surface; (2) the application of rubbing compounds to substantially remove scratches from the surface; (3) application of glazes, polishes and waxes to substantially polish the surface. Each of these operations tends to use a particular type of polishing tool. The applicator 200 preferably allows a variety of polishing tools to be interchanged within the cavity 204 such that a variety of polishing applications may be accomplished using the same applicator.

The polishing tools are preferably in a shape complimentary to the shape of the internal cavity. When the internal cavity is substantially circular, as depicted in FIG. 18B, the polishing tool is preferably substantially circular. The polishing tool is preferably sized to fit within the cavity. The depth 222 of the cavity 206 may be about 0.25 inch to about 1.0 inch, preferably the depth is about 0.5 inches.

In one embodiment, the thickness 232 of polishing tool 220 may be less than depth 222 of the cavity. When placed in the cavity the polishing tool is preferably recessed within the cavity. With the polishing tool recessed within the cavity, the applicator may be set on a surface whereby the body of the applicator may engage the surface without contact occurring between the polishing tool and the surface. In this manner, contact between a surface and a polishing tool may be avoided when the tool is not in use. This may allow the application of a polishing compound to a surface by the applicator, while the polishing tool is not in contact with the surface. After the polishing compound is spread onto the surface, the body may be compressed by the application of force to a top portion of the applicator, causing a decrease in the depth of the cavity such that the polishing tool becomes flush with or extends beyond a bottom surface of the body. This force, when applied to the body allows the polishing tool to contact the surface.

In another embodiment, the thickness 232 of polishing tool 220 is substantially equal to the depth 222 of the cavity. When placed in the cavity a polishing surface of the polishing tool is preferably flush with a bottom surface of the body of the applicator. This may allow the application of a polishing compound to a surface by the applicator while the polishing tool is in contact with the surface. In this manner, the application of polishing compounds may occur concurrently with the polishing of a surface with the polishing tool.

In another embodiment, the thickness 232 of polishing tool 220 is substantially greater than the depth 222 of the cavity. When placed in the cavity a polishing surface of the polishing tool preferably extends away from a bottom surface of the body of the applicator. This may allow the polishing tool to contact the surface without contact occurring between the surface and the body of the applicator. This may allow polishing of the surface to occur without the concurrent application of a polishing compound to a surface. Polishing compounds which have been added to the body of the applicator may be applied to the surface when sufficient force is applied to the applicator to cause the polishing tool to compress such that the bottom surface of the body comes into contact with the surface.

Figure 20:
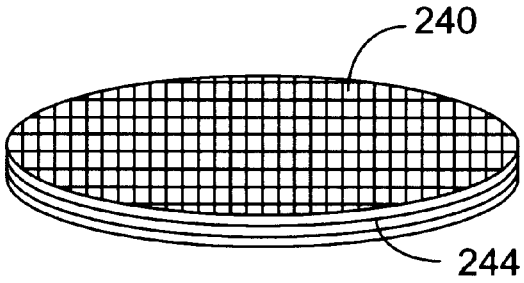
FIG. 20 depicts a plastic flexible tool configured to fit within a circular applicator.

In an embodiment, the polishing tool which may be used with the applicator is preferably a flexible plastic tool as described in the previous embodiments. The plastic flexible tool 240, depicted in FIG. 20 is preferably used to remove a variety of surface level contaminants. The plastic flexible tool 240 may allow the removal of these contaminates without the use of harmful chemicals or harsh abrasives. Preferably, the plastic flexible tool 240 is attached to a portion of a hook-loop fastening system 242 as described in previous embodiments. The plastic flexible tool 240 may have a shape complimentary to the shape of the cavity. If the cavity is circular, the plastic flexible tool 240 is preferably circular. The plastic flexible tool 240 preferably has width which is substantially less than a depth of the cavity 206. The width of the plastic flexible tool is preferably about 0.16 inches.

Figure 21:
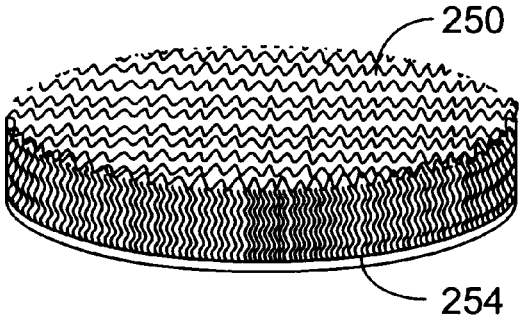
FIG. 21 depicts a wool pad configured to fit within a circular applicator.

In another embodiment, the polishing tool may be a pad made of wool. The wool pad 250, depicted in FIG. 21, may also include synthetic fibers blended with the wool to form a wool blend. The wool pad 250 is preferably attached to a portion of a hook-loop fastening system 254. The wool pad 250 may be fastened to a portion of a hook-loop fastening system 254 by use of glue, a hot melt procedure, a pressure sensitive adhesive, or by sewing. A wool pad 250 may be used for compounding, glazing or polishing operations. Preferably, the wool pad 250 is used for compounding operations. In a typical compounding operation a liquid or paste rubbing compound which includes a fine abrasive is applied to a surface using a wool pad. The wool pad is preferably reciprocated across the surface such that scratches on the surface are removed. The wool pad may also be used in a similar manner to remove oxidized regions (e.g., rust) from the surface. The wool pad 250 is preferably in a shape that is complimentary to a shape of the cavity of the body. The wool pad 250 has a width which is preferably equal to a depth of the cavity 206. The width of the wool pad is preferably about 0.5 inches.

Figure 22:
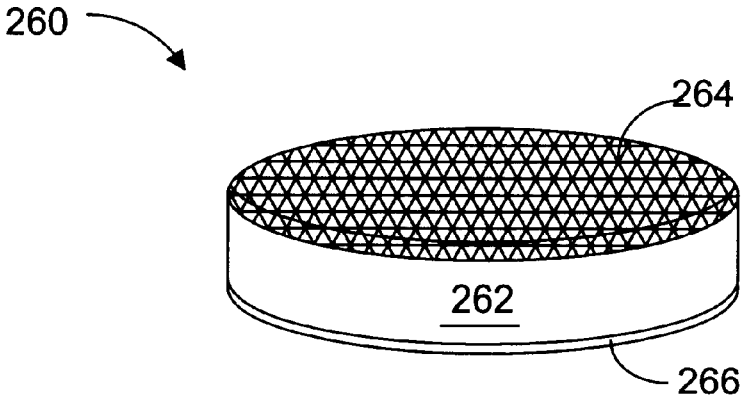
FIG. 22 depicts a sanding pad configured to fit within a circular applicator.
Figure 23:
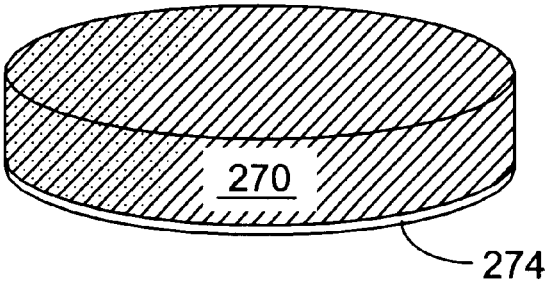
FIG. 23 depicts a foam pad configured to fit within a circular applicator.

In another embodiment, the polishing tool may be a foam pad 270, as depicted in FIG. 22. The foam pad 270 may be a polymeric foam material. Preferably, the pad is made of a urethane foam. The foam material may be chosen according to the surface being polished. For example a more aggressive foam (i.e., those having a relatively low number of pores per inch) tends to be more suitable for polishing surfaces that require relatively harsh treatments. The foam pad is preferably made of a foam having between about 60 pores per inch to about 150 pores per inch, more preferably between about 75 pores per inch to about 125 pores per inch, and more preferably still between about 90 pores per inch to about 10 pores per inch. The foam pad 270 is preferably attached to a portion of a hook-loop fastening system 274. The foam pad 270 may be fastened to a portion of a hook-loop fastening system 274 by use of, e.g., glue, a hot melt procedure or a pressure sensitive adhesive. The foam pad is preferably in a shape that is complimentary to a shape of the cavity of the body. The foam pad has a width which is preferably equal to a depth of the cavity 206. The width of the foam pad is preferably about 0.5 inches.

A foam pad may be used for compounding, polishing or waxing operations. Coarser foam pads (i.e., foam pads having a low number of pores per inch) are preferably used for compounding operations for the removal of scratches produced by sanding operations. Fine grade foam pads (i.e., foam pads having a high number of pores per inch) are preferably used for finishing operations such as polishing or waxing. The use of fine grade foam pads may allow the application of glazes or waxes to a surface such that the formation of swirl marks upon the surface is minimized.

In another embodiment, the polishing tool may be a sanding pad, as depicted in FIG. 22. The sanding pad preferably consists of a foam pad 262 whose outer surface is covered with a thin layer of sanding paper 264. The foam pad portion 262 of the sanding pad may be a polymeric foam material. Preferably, the foam pad is made of a urethane foam. The foam pad portion 262 of the sanding pad 260 is preferably made of a foam having about 60 pores per inch. The foam pad portion 262 of the sanding pad 260 is preferably attached to a portion of a hook-loop fastening system 266. The foam pad portion 262 of the sanding pad 260 may be fastened to a portion of a hook-loop fastening system 266 by use of, e.g., glue, a hot melt procedure, or a pressure sensitive adhesive. The sanding paper 264 may include a fine grit abrasive (e.g., 1200 to 1500 grit). The sanding pad 260 is preferably in a shape that is complimentary to a shape of the cavity. The sanding pad 260 has a width which is preferably equal to a depth of the cavity 206 of the body 202. The width of the sanding pad is preferably about 0.5 inches. A sanding pad made up of a fine grit sanding paper may be used for smoothing or leveling operations. The smoothing operation may be used to remove surface imperfections or protrusions.

Figure 24:
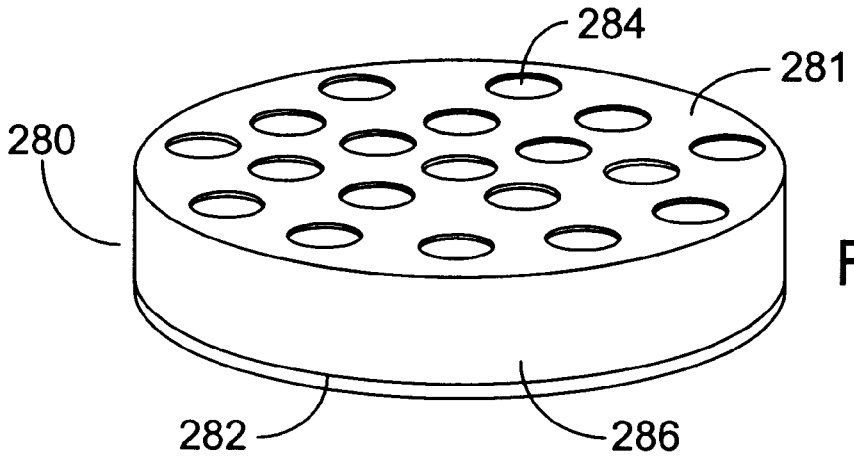
FIG. 24 depicts a cavitied foam pad.

In another embodiment, the polishing tool may be a cavitied foam pad 280, as depicted in FIG. 24. The cavitied foam pad 280 may be a polymeric foam material. Preferably, the cavitied foam pad is made of a polyurethane foam. The foam material may be chosen according to the surface being polished, as has been described previously. The foam pad preferably has between about 60 pores per inch to about 90 pores per inch. A rear face (not shown) of the cavitied foam pad 280 is preferably attached to a portion of a hook-loop fastening system 272. The rear face of the cavitied foam pad 280 may be fastened to a portion of a hook-loop fastening system 282 by use of; e.g., glue, a hot melt procedure or a pressure sensitive adhesive. The cavitied foam pad is preferably in a shape that is complimentary to a shape of the cavity of the body. The cavitied foam pad has a width which is preferably equal to a depth of the cavity 206. The width of the cavitied foam pad is preferably about 0.5 inches.

The cavitied foam pad preferably includes two substantial planar faces, a front face 281 and a rear face (not shown). The front face and rear faces are oriented substantially parallel with respect to each other. A number of cavities are preferably formed in the front face 281 of the pad. The rear face of the pad is preferably uncavitied to facilitate coupling of a portion of a hook-loop fastening system to the rear face.

Figure 25:
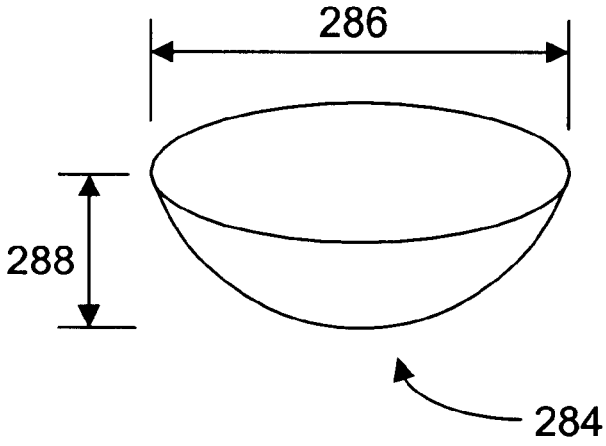
FIG. 25 depicts an enlarged view of a cavity.

The cavitied foam pad has a number of cavities 284 preferably formed within the front face 281 of the foam pad 280. The cavities are preferably uniformly positioned throughout the foam pad 280, as depicted in FIG. 24. A close up of a cavity is depicted in FIG. 25. The cavity is preferably semi-spherical in shape, although a number of other shapes may be used, including square, oval, diamond, rectangular or tear shaped. When the cavity is semi-spherical in shape the diameter 286 of the cavity may be from about 0.25 inch to about 1 inch. A depth of the cavities may vary from between about 0.015 inch to up to about the width of the pad. The number of cavities formed within the foam pad may be dependent on the size of the cavities. Generally, the area occupied by a cavity ranges from about 0.05 square inch to about 1 square inch. When cavities having an area of about 0.05 square inches are formed in a foam pad having a diameter of about 4 inches from about 10 to about 50 cavities may be formed within the foam pad. Additional cavities (not shown) may be formed on the sides 286 of the foam pad.

Foam pads in general are used for a number of polishing operations including glazing operations. Foam pads that do not contain any sort of cavity tend to cause a number of problems during the application of glazes. Excess glaze applied to an uncavitied foam pad tends to be slung onto nearby areas. The excess glaze tends to migrate toward the edges of the foam pad during use. Once the glaze reaches these outer edges the glaze may be thrown from the pad onto the surface. Thus, portions of the surface that may already be polished may become coated with glaze. This slinging tends to lead to non-uniform coating and polishing of the surface.

The use of cavitied foam pads may help prevent these problems. The cavities within the foam pad may serve as traps for excess glaze. When excess glaze is applied to the pad, the glaze may be moved along the surface of the pad and into the cavities. In this manner, the excess glaze is trapped within the cavities and may be inhibited from reaching the outer edges of the pad. Thus, the polishing performed by a pad with such cavities may prevent non-uniform polishing of a surface.

In addition to slinging, excessive production of heat on a surface tends to be a problem experienced during the use of uncavitied foam pads. This problem typically occurs when an uncavitied foam pad is used with a mechanical polisher. The heat is generally produced by friction of the foam pad against the surface. Cavities formed in the foam pad may reduce the heat produced by the pad by reducing the effective surface area of the pad (i.e., the amount of foam material in contact with the surface). This reduction in heat may allow the more uniform application of polishes and waxes.

The size of the cavities may determine the ability of the cavitied pad to minimize the above mentioned problems. If the cavities are too small (e.g., if the cavities occupy less than about 0.05 square inches) too much of the foam pad may contact the surface and thus no significant reduction in heat is obtained. Alternately, if the cavities are too large (e.g., if the cavities occupy more than about 1.0 square inch) the pad may not be able to contact enough of the surface to produce a uniformly polished surface. A uniformly polished surface is a surface which is substantially free of visible marks, such as scratches or swirl marks. The depth of the cavities is also important. If the cavities are too shallow (e.g., if the cavities are less than 0.015 inch deep) the cavities may not be able to contain enough of the excess polishing compounds to prevent slinging.

The cavities are preferably arranged in a pattern such that the cavities are uniformly positioned throughout the pad. This arrangement reduces the friction of the pad against the surface. If the cavities are unevenly arranged throughout the pad, the surface area of the uncavitied portions of the pad may cause excess heat build up despite the presence of the cavities. It is preferable that both the size and arrangement of the cavities is controlled to reduce the heat produced by the pad during polishing.

Additionally the cavities may vary in size with respect to their location within the foam pad. Preferably, the cavities near the outer edges of the foam pad may occupy a surface area that is significantly less than the are occupied by the cavities near the center of the foam pad. This arrangement is preferred for the prevention of slinging of excess polishing compound. During typical usage the polishing compound is preferably applied to the applicator such that more polishing compound is applied to the center portion of the applicator than near the edges. The cavities of the foam pad near the center of the foam pad may therefore be significantly larger than cavities near the edge to compensate for the typical uneven distribution of the polishing compound. The cavities may be formed in a variety of patterns, other than the pattern shown in FIG. 24. The pattern is preferably designed such that both slinging of the polishing compound and heat build from the pad may be minimized.

The cavitied foam pad is preferably prepared by forming scoops in a substantially planar surface of the pad. The cavitied pad may therefore be substantially planar with a number of cavities extending downward into the foam pad. This substantially planar surface preferably allows the user to achieve a polishing force by applying a minimal amount of pressure to the cavitied foam pad. This property may also help reduce the heat produced by the cavitied foam pad, since the friction generated by the pad is directly related to the pressure exerted upon the pad.

The applicator may be connected to a mechanical polisher. The mechanical polisher may be a dual action polisher, an orbital polisher, an oscillating polisher, or any other automatic polisher configured to simulate the motion that characterizes manual polishing. The applicator preferably contains a connecting portion 205 on its top surface for attachment to a mechanical polisher, as depicted in FIG. 19.

In an embodiment a portion of a hook-loop fastening system 205 is mounted on the top surface of the applicator 200. The applicator may be fastened to the mechanical polisher by coupling the portion of the hook-loop fastening system residing on the applicator with a complimentary portion residing on the mechanical polisher. In this manner, the applicator may be easily attached and removed from the mechanical polisher. A portion of a hook-loop fastening system 205 may be attached to the applicator 200 by a glue or a pressure-sensitive adhesive.

Figure 26:
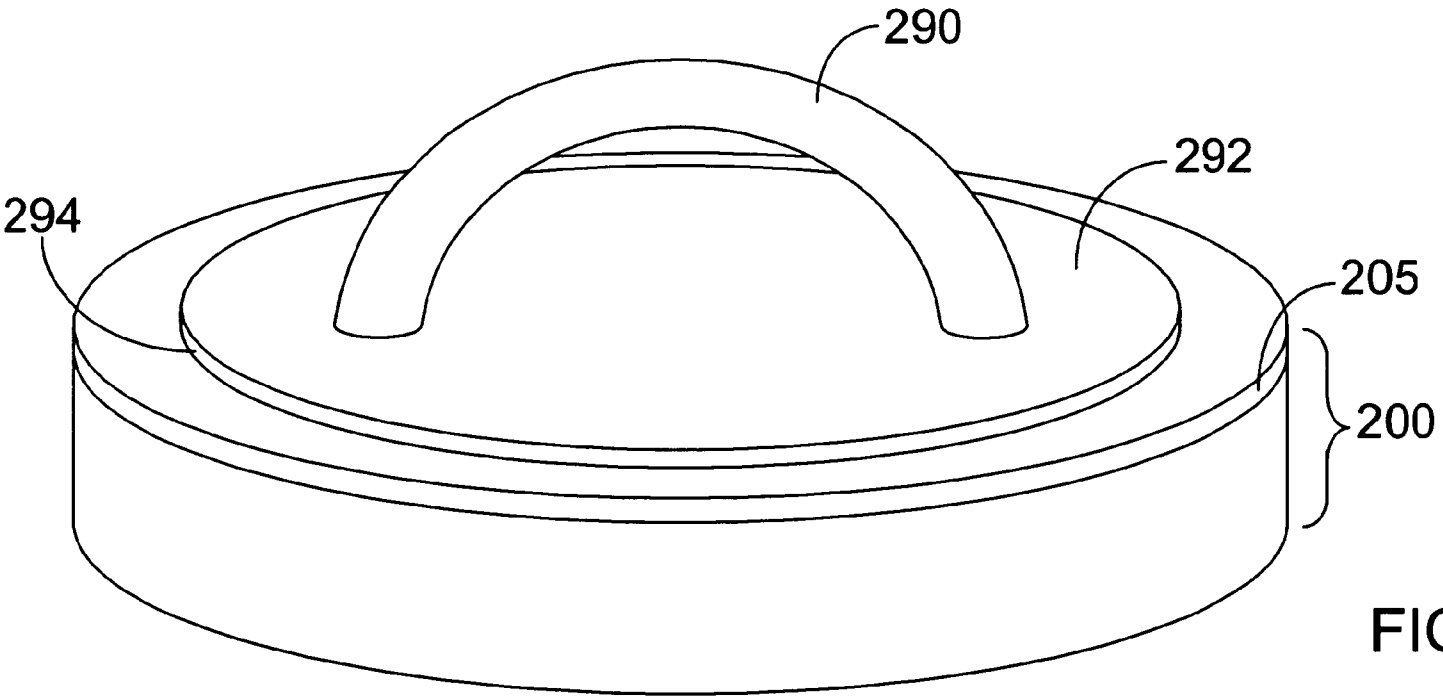
FIG. 26 depicts a handle attached to an applicator.
Figure 27:
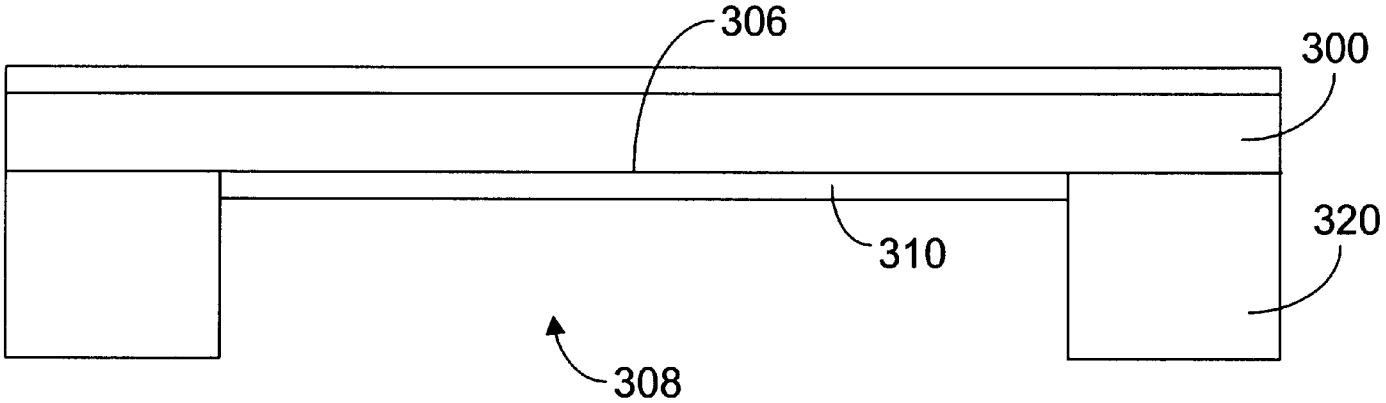
FIG. 27 depicts a cross-sectional view of an applicator which includes a top and bottom section.

In another embodiment the connecting portion 205 may be used to connect the applicator 200 to a hand 290, as depicted in FIG. 26. Handle 290 is preferably attached to a connecting disk 292. The connecting disk is preferably made of a relatively rigid microcell foam or closed cell foam as has been described previously. The handle is preferably secured to the connecting disk by gluing or sewing. The handle may be a strap made of a flexible material, the material being sufficiently flexible to expand when a hand is inserted between the handle and the connecting disk. The handle preferably applies a force upon a hand inserted between the handle and the disk such that the hand is secured to the connecting disk 292. The connecting disk is preferably attached to a portion of a hook-loop system. The applicator may be fastened to the connecting disk of the handle by coupling the portion of the hook-loop fastening system residing on the applicator with a complimentary portion residing on the connecting disk. In this manner, the applicator may be easily attached and removed from the handle. A portion of a hook-loop fastening system 294 may be attached to the connecting disk 292 by a glue or a pressure-sensitive adhesive In an embodiment of the applicator, depicted in FIG. 27, the body includes a top section 300 and a bottom section 320. The top and bottom sections may be glued together or connected via a pressure sensitive adhesive. The bottom section is preferably made of a compressible or flexible material, and the top and bottom sections may have different compressibilities and/or flexibilities. The top section is preferably more rigid and/or less compressible than the bottom section. Such an applicator system has been described in previous embodiments.

The lower surface 306 of the top section 300 and the bottom section 320 together form the cavity 308 of the applicator. The lower surface 306 of the applicator preferably is configured to have a polishing tool removably attached to the lower surface. Preferably a portion 310 of a hook-loop fastening system is attached to the lower surface 306. The portion 310 of the hook-loop system is configured for attachment to a complementary portion of a hook-loop fastening system located on a polishing tool. A portion 310 of a hook-loop fastening system may be attached to lower surface 306 by a glue or a pressure-sensitive adhesive. The use of a hook-loop system may allow a variety of polishing tools to be removably attached to the applicator.

Figure 28:
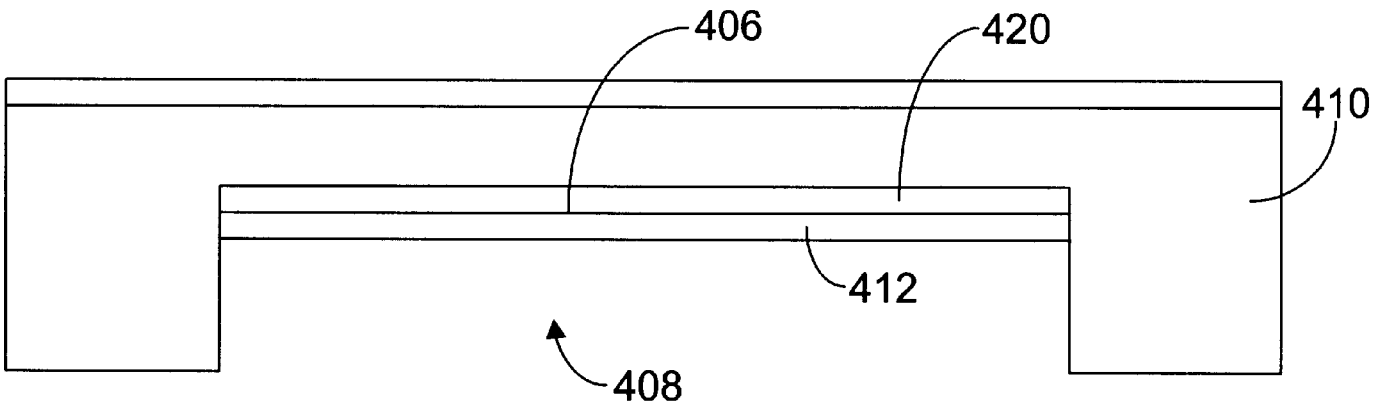
FIG. 28 depicts a cross sectional view of an applicator which includes a liner.

In another embodiment, an applicator may include a liner 420, as depicted in FIG. 28. The liner is preferably made of a foam. The liner preferably resides in the cavity. The liner is preferably attached to an inner surface of the cavity. The liner 420 and the body 410 are preferably glued together or connected via a pressure-sensitive adhesive. The lower surface 406 of the liner 420 preferably is configured to have a polishing tool removably attached to the lower surface. Preferably, a portion 412 of a hook-loop fastening system is attached to the lower surface 406. The portion 412 of the hook-loop system is configured for attachment to a complementary portion of a hook-loop fastening system located on a polishing tool. A portion 412 of a hook-loop fastening system may be attached to lower surface 406 by a glue or a pressure-sensitive adhesive. The use of a liner may facilitate construction of the applicator by providing a clean surface for attachment of the portion of the hook-loop fastening system.

Use of a system which includes an applicator and a variety of polishing tools as described above, preferably allows a variety of polishing operations to be accomplished with the same applicator. The applicator is preferably made of a foam body which is particularly suited to absorb lubricating agents, polishes, glazes or other polishing compounds. The applicator may store these compounds and selectively dispense the polishing compounds onto a surface while it is polished. The applicator may be bundled and presented as a kit having a variety of interchangeable polishing tools all configured to fit within the cavity of the applicator. The polishing tools may include tools for sanding, removal of surface imperfections, compounding, glazing and polishing. When bundled as a kit the system may include all of the necessary tools for the completion of a variety of surface finishing operations. The kit may also include a variety of polishing compounds for the various polishing operations.

The polishing of a surface may include a variety of polishing operations including, but not limited to sanding, removal of surface imperfections, compounding, glazing and polishing. Typically, each of these operations may require the use of a separate polishing tool. The use of an applicator with interchangeable polishing tools, as described above, allows a variety of these polishing operations to be accomplished by simply interchanging the polishing tools.

In an embodiment, a first polishing tool is placed in the applicator. The first polishing tool is then used to polish a portion of the surface. The polishing is preferably performed by reciprocating the applicator across the surface such that the polishing tool comes in contact with the surface. The reciprocating may be accomplished by hand or by a mechanical polisher.

After the first polishing operation is completed, the first polishing tool may be removed from the applicator and a second polishing tool inserted therein. The second polishing tool may then be used to polish a portion of the surface. The polishing is performed by reciprocating the polishing tool across the surface such that the second polishing tool comes in contact with the surface. The reciprocating may be accomplished by hand or by mechanical polisher.

During the polishing operations, a polishing compound may be added to the applicator prior to polishing the surface. These polishing compounds may be absorbed by the applicator to allow dispersal of the polishing compounds during the polishing operation. Alternately, the polishing compounds may be applied directly to the surface.

It is to be understood that these Further Improvements may be used in combination with any of the embodiments described in the previous sections.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for polishing a surface, comprising:

a tool configured to substantially polish the surface during use; and an applicator for guiding the tool, the applicator comprising a body and a cavity having an inner surface, at least a portion of the body being substantially compressible during use;

and wherein a thickness of the tool is substantially greater than a depth of the cavity such that a portion of the tool extends out from the cavity during use.

2. The system of claim 1 wherein the tool is removably attachable to the inner surface of the cavity during use.

3. The system of claim 1 wherein the body is configured to absorb a polishing compound during use, the body being configured to dispense an amount of polishing compound upon being compressed during use, and wherein the amount of polishing compound dispensed varies as a function of a degree to which the body is compressed during use.

4. The system of claim 1 wherein the applicator further comprises a portion of a hook-loop fastening system positioned on the inner surface of the cavity, and wherein the tool further comprises a complementary portion of the hook-loop fastening system, and wherein the applicator portion is configured to form a fixable engagement with the complementary portion during use.

5. The system of claim 1 wherein the applicator further comprises a portion of a hook-loop fastening system located on a top surface of the body, the portion of the hook-loop fastening system being configured to form a fixable engagement with a complementary portion of the hook-loop fastening system attached to a mechanical polisher during use.

6. The system of claim 1 wherein the body comprises a curved portion having an ergonomic shape to facilitate grasping of the body.

7. The system of claim 1 wherein the body comprises a top section and a bottom section, the top section comprising a first compressible material, the bottom section comprising a second compressible material, the first compressible material being more rigid than the second compressible material, the cavity being formed within the bottom section.

8. The system of claim 1 wherein the tool comprises a plastic flexible material having mixed therewith an abrasive comprising grains, and wherein the abrasive grains have a diameter of about 3 $\mu$m to about 50 $\mu$m.

9. The system of claim 1, wherein the tool comprises a foam pad having between about 60 pores per inch to about 150 pores per inch.

10. The system of claim 1, wherein the tool comprises a crosslinked polyethylene foam pad having between about 60 pores per inch to about 150 pores per inch.

11. The system of claim 1, wherein the tool comprises a foam pad, wherein the foam pad has a plurality of cavities disposed within an upper surface of the foam pad, and wherein the cavities are substantially semi-spherical.

12. The system of claim 1, further comprising a plastic film for locating a stain or protrusion on the surface, the plastic film being sized to cover at least a portion of a human hand, the plastic film having a thickness between about 0.1 mm and about 0.75 mm.

13. The system of claim 1 wherein the applicator further comprises a portion of a hook-loop fastening system located on a top surface of the body, the portion of a hook-loop fastening system being configured to form a fixable engagement with a complementary portion of a hook-loop fastening system attached to a surface of a handle during use.

14. The system of claim 1 wherein the surface comprises a surface.

15. The system of claim 1 wherein the applicator has a density that causes the applicator to float on water.

16. The system of claim 1, wherein the tool comprises a plastic flexible material having mixed therewith an abrasive comprising grains, and wherein the surface comprises a vehicle surface, and wherein the applicator has a density that causes the applicator to float on water.

17. A system for polishing a surface, comprising:

a tool configured to substantially polish the surface during use; and an applicator for guiding the tool, the applicator comprising a body and a cavity having an inner surface, the body comprising a top section and a bottom section, the top section comprising a first compressible material and the bottom section comprising a second compressible material, the first compressible material being more rigid than the second compressible material, the cavity being formed within the bottom section, and wherein the first compressible material is a plastomer foam and the second compressible material is an elastomer foam;

and wherein the tool is configured to be contained within the cavity during use.

18. The system of claim 17 wherein the tool is removably attachable to the inner surface of the cavity during use.

19. The system of claim 17 wherein the body is configured to absorb a polishing compound during use, the body being configured to dispense an amount of polishing compound upon being compressed during use, and wherein the amount of polishing compound dispensed varies as a function of a degree to which the body is compressed during use.

20. The system of claim 17 wherein the applicator further comprises a portion of a hook-loop fastening system positioned on the inner surface of the cavity, and wherein the tool further comprises a complementary portion of the hook-loop fastening system, and wherein the applicator portion is configured to form a fixable engagement with the complementary portion during use.

21. The system of claim 17 wherein the applicator further comprises a portion of a hook-loop fastening system located on a top surface of the body, the portion of the hook-loop fastening system being configured to form a fixable engagement with a complementary portion of the hook-loop fastening system attached to a mechanical polisher during use.

22. The system of claim 17 wherein the tool comprises a plastic flexible material having mixed therewith an abrasive comprising grains, and wherein the abrasive grains have a diameter of about 3 $\mu$m to about 50 $\mu$m.

23. The system of claim 17, wherein the tool comprises a foam pad having between about 60 pores per inch to about 150 pores per inch.

24. The system of claim 17, wherein the tool comprises a crosslinked polyethylene foam pad having between about 60 pores per inch to about 150 pores per inch.

25. The system of claim 17, wherein the tool comprises a foam pad, wherein the foam pad has a plurality of cavities disposed within an upper surface of the foam pad, and wherein the cavities are substantially semi-spherical.

26. The system of claim 17, further comprising a plastic film for locating a stain or protrusion on the surface, the plastic film being sized to cover at least a portion of a human hand, the plastic film having a thickness between about 0.1 mm and about 0.75 mm.

27. The system of claim 17 wherein the applicator further comprises a portion of a hook-loop fastening system located on a top surface of the body, the portion of a hook-loop fastening system being configured to form a fixable engagement with a complementary portion of a hook-loop fastening system attached to a surface of a handle during use.

28. The system of claim 17 wherein the surface comprises a surface.

29. The system of claim 17 wherein the applicator has a density that causes the applicator to float on water.

30. The system of claim 17, wherein the tool comprises a plastic flexible material having mixed therewith an abrasive comprising grains, and wherein the surface comprises a vehicle surface, and wherein the applicator has a density that causes the applicator to float on water.

31. A system for polishing a surface, comprising:

a tool configured to substantially polish the surface during use;

an applicator for guiding the tool, the applicator comprising a body and a cavity having an inner surface; and a plastic film for locating a stain or protrusion on the surface of the vehicle, the plastic film being sized to cover at least a portion of a human hand, the plastic film having a thickness between about 0.1 mm and about 0.75 mm;

and wherein the tool is configured to be contained within the cavity during use such that the tool is removably attachable to the inner surface of the cavity during use.

32. The system of claim 31 wherein the tool is removably attachable to the inner surface of the cavity during use.

33. The system of claim 31 wherein the body is configured to absorb a polishing compound during use, the body being configured to dispense an amount of polishing compound upon being compressed during use, and wherein the amount of polishing compound dispensed varies as a function of a degree to which the body is compressed during use.

34. The system of claim 31 wherein the applicator further comprises a portion of a hook-loop fastening system positioned on the inner surface of the cavity, and wherein the tool further comprises a complementary portion of the hook-loop fastening system, and wherein the applicator portion is configured to form a fixable engagement with the complementary portion during use.

35. The system of claim 31 wherein the applicator further comprises a portion of a hook-loop fastening system located on a top surface of the body, the portion of the hook-loop fastening system being configured to form a fixable engagement with a complementary portion of the hook-loop fastening system attached to a mechanical polisher during use.

36. The system of claim 31 wherein the body comprises a top section and a bottom section, the top section comprising a first compressible material, the bottom section comprising a second compressible material, the first compressible material being more rigid than the second compressible material, the cavity being formed within the bottom section.

37. The system of claim 31 wherein the tool comprises a plastic flexible material having mixed therewith an abrasive comprising grains, and wherein the abrasive grains have a diameter of about 3 $\mu$m to about 50 $\mu$m.

38. The system of claim 31, wherein the tool comprises a foam pad having between about 60 pores per inch to about 150 pores per inch.

39. The system of claim 31, wherein the tool comprises a crosslinked polyethylene foam pad having between about 60 pores per inch to about 150 pores per inch.

40. The system of claim 31, wherein the tool comprises a foam pad, wherein the foam pad has a plurality of cavities disposed within an upper surface of the foam pad, and wherein the cavities are substantially semi-spherical.

41. The system of claim 31, wherein the plastic film has a modulus of elasticity according to ASTM test D-882, Method A, of between about 50,000 psi and about 120,000 psi at 73° F.

42. The system of claim 31 wherein the applicator further comprises a portion of a hook-loop fastening system located on a top surface of the body, the portion of a hook-loop fastening system being configured to form a fixable engagement with a complementary portion of a hook-loop fastening system attached to a surface of a handle during use.

43. The system of claim 31 wherein the surface comprises a surface.

44. The system of claim 31 wherein the applicator has a density that causes the applicator to float on water.

45. The system of claim 31, wherein the tool comprises a plastic flexible material having mixed therewith an abrasive comprising grains, and wherein the surface comprises a vehicle surface, and wherein the applicator has a density that causes the applicator to float on water.

46. The system of claim 1, wherein the body comprises a top section and a bottom section, the top section comprising a first compressible material and the bottom section comprising a second compressible material.

47. The system of claim 1, wherein the body comprises a top section and a bottom section, the top section comprising a first compressible material and the bottom section comprising a second compressible material, and wherein the first compressible material is more rigid than the second compressible material, and wherein the cavity is formed in the bottom section.

48. The system of claim 1, wherein the body comprises a top section and a bottom section, the top section comprising a first compressible material and the bottom section comprising a second compressible material, and wherein at least a portion of the inner surface of the cavity is defined by a lower portion of the top section.

49. The system of claim 1, wherein the body comprises a top section and a bottom section, the top section comprising a first compressible material and the bottom section comprising a second compressible material, and wherein the top section is substantially impermeable to polishing compounds.

50. The system of claim 1, wherein the body comprises a top section and a bottom section, the top section comprising a first compressible material and the bottom section comprising a second compressible material, and wherein the applicator further comprises a pressure-sensitive adhesive connecting the top section and the bottom section together.

51. The system of claim 1, wherein the body comprises a top section and a bottom section, the top section comprising a first compressible material and the bottom section comprising a second compressible material, and wherein the applicator further comprises a glue disposed between the top section and the bottom section.

52. The system of claim 1, wherein the body comprises a top section and a bottom section, the top section comprising a first compressible material and the bottom section comprising a second compressible material, and wherein the first compressible material is a plastomer foam and the second compressible material is an elastomer foam.

53. The system of claim 1, wherein the body comprises a top section and a bottom section, the top section comprising a first compressible material and the bottom section comprising a second compressible material, and wherein the first compressible material is a crosslinked polyethylene foam, and wherein the second compressible material is a urethane foam.

54. The system of claim 1, wherein the body comprises a top section and a bottom section, the top section comprising a first compressible material and the bottom section comprising a second compressible material, and wherein the first compressible material is a closed-cell metallocene polyolefin foam, and wherein the second compressible material is a urethane foam.

55. The system of claim 1, wherein the tool is adapted to being reciprocated across the surface while contacting the surface and adhering to the inner surface of the cavity during use.

56. The system of claim 1, wherein the tool is deformable to substantially conform to the shape of the surface.

57. The system of claim 1, wherein the tool comprises a plastic flexible material having mixed therewith an abrasive comprising grains, and wherein the abrasive grains are substantially homogeneously mixed with the plastic flexible material.

58. The system of claim 1, wherein the tool comprises a plastic flexible material having mixed therewith an abrasive comprising grains, and wherein the tool comprises between about 6 parts and about 8 parts of abrasive per 10 parts by weight of plastic flexible material.

59. The system of claim 1 wherein the tool comprises a plastic flexible material having mixed therewith an abrasive comprising grains, and wherein the abrasive comprises silica sand, calcium carbonate, alumina, ceramics, and Green Carborundum.

60. The system of claim 1 wherein the tool comprises a plastic flexible material having mixed therewith an abrasive comprising grains, and wherein the tool comprises a plurality of particles dispersed throughout the plastic flexible material, the particles being adapted to knead the plastic flexible material during use.

61. The system of claim 1, wherein the tool comprises a foam pad.

62. The system of claim 1, wherein the tool comprises a wool pad.

63. The system of claim 1 wherein the tool comprises a substantially flexible foam pad, wherein an outer surface of the foam pad comprises sandpaper.

64. The system of claim 1, further comprising a plastic film for locating a stain or protrusion on the surface, the plastic film being sized and adapted to cover at least a portion of a human hand, the plastic film having a modulus of elasticity according to ASTM test D-882, Method A, of between about 50,000 psi and about 120,000 psi at 73° F., the plastic film having a thickness between about 0.1 mm and about 0.75 mm.

65. The system of claim 1 further comprising a polishing compound.

66. The system of claim 1 wherein the tool is positionable within the cavity during use such that the body covers at least about half of a surface area of the tool.

67. The system of claim 1 wherein the body is a substantially circular disk, and wherein the cavity has a substantially circular shape.

68. The system of claim 1, wherein the tool comprises a plastic flexible material having mixed therewith an abrasive comprising grains, and wherein the surface comprises a vehicle surface, and wherein the applicator has a density that causes the applicator to float on water.

69. The system of claim 17, and wherein at least a portion of an inner surface of the cavity is defined by a lower portion of the top section.

70. The system of claim 17 wherein the top section is substantially impermeable to polishing compounds.

71. The system of claim 17 wherein the applicator further comprises a pressure-sensitive adhesive coupling the top section and the bottom section together.

72. The system of claim 17 wherein the applicator further comprises a glue disposed between the top section and the bottom section.

73. The system of claim 17 wherein the bottom section comprises a bottom surface located about a perimeter of the cavity, and wherein the cavity is configured to contain the tool such that the tool is recessed within the cavity with respect to the bottom surface during use.

74. The system of claim 17 wherein the bottom section comprises a bottom surface about a perimeter of the cavity, and wherein the cavity is configured to contain the tool such that the tool is recessed within the cavity with respect to the bottom surface, and wherein the body is compressible to cause the tool to become substantially flush with the bottom surface of the tool during use.

75. The system of claim 17 wherein a thickness of the tool is substantially greater than a depth of the cavity such that a portion of the tool extends out from the cavity during use.

76. The system of claim 17 wherein the bottom section comprises a bottom surface about a perimeter of the cavity, and wherein a thickness of the tool is substantially equal to a depth of the cavity such that an upper surface of the tool is substantially flush with the bottom surface of the body during use.

77. The system of claim 17 wherein the tool is configured to being reciprocated across the surface while contacting the surface and adhering to an inner surface of the cavity during use.

78. The system of claim 17 wherein the tool is deformable to substantially conform to the shape of the surface.

79. The system of claim 17 wherein the tool comprises a plastic flexible material having mixed therewith an abrasive comprising grains, and wherein the abrasive grains are substantially homogeneously mixed with the plastic flexible material.

80. The system of claim 17 wherein the tool comprises a plastic flexible material having mixed therewith an abrasive comprising grains, and wherein the tool comprises between about 6 parts and about 8 parts of abrasive per 10 parts by weight of plastic flexible material.

81. The system of claim 17 wherein the tool comprises a plastic flexible material having mixed therewith an abrasive comprising grains, and wherein the abrasive comprises silica sand, calcium carbonate, alumina, ceramics, and Green Carborundum.

82. The system of claim 17 wherein the tool comprises a plastic flexible material having mixed therewith an abrasive comprising grains, and wherein the tool comprises a plurality of particles dispersed throughout the plastic flexible material, the particles being adapted to knead the plastic flexible material during use.

83. The system of claim 17, wherein the tool comprises a foam pad.

84. The system of claim 17, wherein the tool comprises a wool pad.

85. The system of claim 17, wherein the tool comprises a crosslinked polyethylene foam pad having between about 60 pores per inch to about 150 pores per inch.

86. The system of claim 17 wherein the tool comprises a substantially flexible foam pad, wherein an outer surface of the foam pad comprises sandpaper.

87. The system of claim 17 further comprising a plastic film for locating a stain or protrusion on the-surface, the plastic film being sized and adapted to cover at least a portion of a human hand, the plastic film having a modulus of elasticity according to ASTM test D882, Method A, of between about 50,000 psi and about 120,000 psi at 73° F., the plastic film having a thickness between about 0.1 mm and about 0.75 mm.

88. The system of claim 17 further comprising a polishing compound.

89. The system of claim 17 wherein the tool is positionable within the cavity during use such that the body covers at least about half of a surface area of the tool.

90. The system of claim 17 wherein the body is a substantially circular disk, and wherein the cavity has a substantially circular shape.

91. The system of claim 31, wherein the body comprises a top section and a bottom section, the top section comprising a first compressible material and the bottom section comprising a second compressible material.

92. The system of claim 31, wherein the body comprises a top section and a bottom section, the top section comprising a first compressible material and the bottom section comprising a second compressible material, and wherein at least a portion of the inner surface of the cavity is defined by a lower portion of the top section.

93. The system of claim 31 wherein the body comprises a top section and a bottom section, the top section comprising a first compressible material and the bottom section comprising a second compressible material, and wherein the top section is substantially impermeable to polishing compounds.

94. The system of claim 31 wherein the body comprises a top section and a bottom section, the top section comprising a first compressible material and the bottom section comprising a second: compressible material, and wherein the applicator further comprises a pressure-sensitive adhesive connecting the top section and the bottom section together.

95. The system of claim 31 wherein the body comprises a top section and a bottom section, the top section comprising a first compressible material and the bottom section comprising a second compressible material, and wherein the applicator further comprises a glue disposed between the top section and the bottom section.

96. The system of claim 31 wherein the body comprises a top section and a bottom section, the top section comprising a first compressible material and the bottom section comprising a second compressible material, and wherein the first compressible material is a plastomer foam and the second compressible material is an elastomer foam.

97. The system of claim 31 wherein the body comprises a top section and a bottom section, the top section comprising a first compressible material and the bottom section comprising a second compressible material, and wherein the first compressible material is a crosslinked polyethylene foam, and wherein the second compressible material is a urethane foam.

98. The system of claim 31 wherein the body comprises a top section and a bottom section, the top section comprising a first compressible material and the bottom section comprising a second compressible material, and wherein the first compressible material is a closed-cell metallocene polyolefin foam, and wherein the second compressible material is a urethane foam.

99. The system of claim 31 wherein the body comprises a bottom surface located about a perimeter of the cavity, and wherein the cavity is configured to contain the tool such that the tool is recessed within the cavity with respect to the bottom surface during use.

100. The system of claim 31 wherein the body comprises a bottom surface about a perimeter of the cavity, and wherein the cavity is configured to contain the tool such that the tool is recessed within the cavity with respect to the bottom surface, and wherein the body is compressible to cause the tool to become substantially flush with the bottom surface of the tool during use.

101. The system of claim 31 wherein a thickness of the tool is substantially greater than a depth of the cavity such that a portion of the tool extends out from the cavity during use.

102. The system of claim 31 wherein the body comprises a bottom surface about a perimeter of the cavity, and wherein a thickness of the tool is substantially equal to a depth of the cavity such that an upper surface of the tool is substantially flush with the bottom surface of the body during use.

103. The system of claim 31 wherein the tool is configured to be reciprocated across the surface while contacting the surface and adhering to the inner surface of the cavity during use.

104. The system of claim 31 wherein the tool is deformable to substantially conform to the shape of the surface.

105. The system of claim 31 wherein the tool comprises a plastic flexible material having mixed therewith an abrasive comprising grains, and wherein the abrasive grains are substantially homogeneously mixed with the plastic flexible material.

106. The system of claim 31 wherein the tool comprises a plastic flexible material having mixed therewith an abrasive comprising grains, and wherein the tool comprises between about 6 parts and about 8 parts of abrasive per 10 parts by weight of plastic flexible material.

107. The system of claim 31 wherein the tool comprises a plastic flexible material having mixed therewith an abrasive comprising grains, and wherein the abrasive comprises silica sand, calcium carbonate, alumina, ceramics, and Green Carborundum.

108. The system of claim 31 wherein the tool comprises a plastic flexible material having mixed therewith an abrasive comprising grains, and wherein the tool comprises a plurality of particles dispersed throughout the plastic flexible material, the particles being adapted to knead the plastic flexible material during use.

109. The system of claim 31, wherein the tool comprises a foam pad.

110. The system of claim 31, wherein the tool comprises a wool pad.

111. The system of claim 31, wherein the tool comprises a substantially flexible foam pad, wherein an outer surface of the foam pad comprises sandpaper.

112. The system of claim 31 further comprising a polishing compound.

113. The system of claim 31 wherein the tool is positionable within the cavity during use such that the body covers at least about half of a surface area of the tool.

114. The system of claim 31 wherein the body is a substantially circular disk, and wherein the cavity has a substantially circular shape.

115. A system for polishing a surface, comprising:

a tool configured to substantially polish the surface during use; and an applicator for guiding the tool, the applicator comprising a body and a cavity having an inner surface, the body comprising a top section and a bottom section, the top section comprising a first compressible material and the bottom section comprising a second compressible material, the first compressible material being more rigid than the second compressible material, the cavity being formed within the bottom section, and wherein the first compressible material is a crosslinked polyethylene foam, and wherein the second compressible material is a urethane foam;

and wherein the tool is configured to be contained within the cavity during use.

116. The system of claim 115 wherein the tool is removably attachable to the inner surface of the cavity during use.

117. The system of claim 115 wherein the body is configured to absorb a polishing compound during use, the body being configured to dispense an amount of polishing compound upon being compressed during use, and wherein the amount of polishing compound dispensed varies as a function of a degree to which the body is compressed during use.

118. The system of claim 115, and wherein at least a portion of an inner surface of the cavity is defined by a lower portion of the top section.

119. The system of claim 115 wherein the top section is substantially impermeable to polishing compounds.

120. The system of claim 115 wherein the applicator further comprises a pressure-sensitive adhesive coupling the top section and the bottom section together.

121. The system of claim 115 wherein the applicator further comprises a glue disposed between the top section and the bottom section.

122. The system of claim 115 wherein the bottom section comprises a bottom surface located about a perimeter of the cavity, and wherein the cavity is configured to contain the tool such that the tool is recessed within the cavity with respect to the bottom surface during use.

123. The system of claim 115 wherein the bottom section comprises a bottom surface about a perimeter of the cavity, and wherein the cavity is configured to contain the tool such that the tool is recessed within the cavity with respect to the bottom surface, and wherein the body is compressible to cause the tool to become substantially flush with the bottom surface of the tool during use.

124. The system of claim 115 wherein a thickness of the tool is substantially greater than a depth of the cavity such that a portion of the tool extends out from the cavity during use.

125. The system of claim 115 wherein the applicator further comprises a portion of a hook-loop fastening system positioned on the inner surface of the cavity, and wherein the tool further comprises a complementary portion of the hook-loop fastening system, and wherein the applicator portion is configured to form a fixable engagement with the complementary portion during use.

126. The system of claim 115 wherein the applicator further comprises a portion of a hook-loop fastening system located on a top surface of the body, the portion of the hook-loop fastening system being configured to form a fixable engagement with a complementary portion of the hook-loop fastening system attached to a mechanical polisher during use.

127. The system of claim 115 wherein the tool comprises a plastic flexible material having mixed therewith an abrasive comprising grains, and wherein the abrasive grains have a diameter of about 3 $\mu$m to about 50 $\mu$m.

128. The system of claim 115 wherein the tool comprises a plastic flexible material having mixed therewith an abrasive comprising grains, and wherein the abrasive grains are substantially homogeneously mixed with the plastic flexible material.

129. The system of claim 115 wherein the tool comprises a plastic flexible material having mixed therewith an abrasive comprising grains, and wherein the tool comprises between about 6 parts and about 8 parts of abrasive per 10 parts by weight of plastic flexible material.

130. The system of claim 115 wherein the tool comprises a plastic flexible material having mixed therewith an abrasive comprising grains, and wherein the abrasive comprises silica sand, calcium carbonate, alumina, ceramics, and Green Carborundum.

131. The system of claim 115 wherein the tool comprises a plastic flexible material having mixed therewith an abrasive comprising grains, and wherein the tool comprises a plurality of particles dispersed throughout the plastic flexible material, the particles being adapted to knead the plastic flexible material during use.

132. The system of claim 115, wherein the tool comprises a foam pad.

133. The system of claim 115, wherein the tool comprises a foam pad having between about 60 pores per inch to about 150 pores per inch.

134. The system of claim 115, wherein the tool comprises a crosslinked polyethylene foam pad having between about 60 pores per inch to about 150 pores per inch.

135. The system of claim 115, wherein the tool comprises a foam pad, wherein the foam pad has a plurality of cavities disposed within an upper surface of the foam pad, and wherein the cavities are, substantially semi-spherical.

136. The system of claim 115, further comprising a plastic film for locating a stain or protrusion on the surface, the plastic film being sized to cover at least a portion of a human hand, the plastic film having a thickness between about 0.1 mm and about 0.75 mm.

137. The system of claim 115, further comprising a plastic film for locating a stain or protrusion on the surface, the plastic film being sized and adapted to cover at least a portion of a human hand, the plastic film having a modulus of elasticity according to ASTM test D882, Method A, of between about 50,000 psi and about 120,000 psi at 73° F., the plastic film having a thickness between about 0.1 mm and about 0.75 mm.

138. The system of claim 115 wherein the applicator further comprises a portion of a hook-loop fastening system located on a top surface of the body, the portion of a hook-loop fastening system being configured to form a fixable engagement with a complementary portion of a hook-loop fastening system attached to a surface of a handle during use.

139. The system of claim 115 wherein the surface comprises a surface.

140. The system of claim 115 wherein the applicator has a density that causes the applicator to float on water.

141. The system of claim 115, wherein the tool comprises a plastic flexible material having mixed therewith an abrasive comprising grains, and wherein the surface comprises a vehicle surface, and wherein the applicator has a density that causes the applicator to float on water.

142. The system of claim 115 further comprising a polishing compound.

143. The system of claim 115 wherein the tool is positionable within the cavity during use such that the body covers at least about half of a surface area of the tool.

144. The system of claim 115 wherein the body is a substantially circular disk, and wherein the cavity has a substantially circular shape.

145. A system for polishing a surface, comprising:

a tool configured to substantially polish the surface during use; and an applicator for guiding the tool, the applicator comprising a body and a cavity having an inner surface, the body comprising a top section and a bottom section, the top section comprising a first compressible material and the bottom section comprising a second compressible material, the first compressible material being more rigid than the second compressible material, the cavity being formed within the bottom section, and wherein the first compressible material is a closed-cell metallocene polyolefin foam, and wherein the second compressible material is a urethane foam;

and wherein the tool is configured to be contained within the cavity during use.

146. The system of claim 145 wherein the tool is removably attachable to the inner surface of the cavity during use.

147. The system of claim 145 wherein the body is configured to absorb a polishing compound during use, the body being configured to dispense an amount of polishing compound upon being compressed during use, and wherein the amount of polishing compound dispensed varies as a function of a degree to which the body is compressed during use.

148. The system of claim 145, and wherein at least a portion of an inner surface of the cavity is defined by a lower portion of the top section.

149. The system of claim 145 wherein the top section is substantially impermeable to polishing compounds.

150. The system of claim 145 wherein the applicator further comprises a pressure-sensitive adhesive coupling the top section and the bottom section together.

151. The system of claim 145 wherein the applicator further comprises a glue disposed between the top section and the bottom section.

152. The system of claim 145 wherein the bottom section comprises a bottom surface located about a perimeter of the cavity, and wherein the cavity is configured to contain the tool such that the tool is recessed within the cavity with respect to the bottom surface during use.

153. The system of claim 145 wherein the bottom section comprises a bottom surface about a perimeter of the cavity, and wherein the cavity is configured to contain the tool such that the tool is recessed within the cavity with respect to the bottom surface, and wherein the body is compressible to cause the tool to become substantially flush with the bottom surface of the tool during use.

154. The system of claim 145 wherein a thickness of the tool is substantially greater than a depth of the cavity such that a portion of the tool extends out from the cavity during use.

155. The system of claim 145 wherein the applicator further comprises a portion of a hook-loop fastening system positioned on the inner surface of the cavity, and wherein the tool further comprises a complementary portion of the hook-loop fastening system, and wherein the applicator portion is configured to form a fixable engagement with the complementary portion during use.

156. The system of claim 145 wherein the applicator further comprises a portion of a hook-loop fastening system located on a top surface of the body, the portion of the hook-loop fastening system being configured to form a fixable engagement with a complementary portion of the hook-loop fastening system attached to a mechanical polisher during use.

157. The system of claim 145 wherein the tool comprises a plastic flexible material having mixed therewith an abrasive comprising grains, and wherein the abrasive grains have a diameter of about 3 $\mu$m to about 50 $\mu$m.

158. The system of claim 145 wherein the tool comprises a plastic flexible material having mixed therewith an abrasive comprising grains, and wherein the abrasive grains are substantially homogeneously mixed with the plastic flexible material.

159. The system of claim 145 wherein the tool comprises a plastic flexible material having mixed therewith an abrasive comprising grains, and wherein the tool comprises between about 6 parts and about 8 parts of abrasive per 10 parts by weight of plastic flexible material.

160. The system of claim 145 wherein the tool comprises a plastic flexible material having mixed therewith an abrasive comprising grains, and wherein the abrasive comprises silica sand, calcium carbonate, alumina, ceramics, and Green Carborundum.

161. The system of claim 145 wherein the tool comprises a plastic flexible material having mixed therewith an abrasive comprising grains, and wherein the tool comprises a plurality of particles dispersed throughout the plastic flexible material, the particles being adapted to knead the plastic flexible material during use.

162. The system of claim 145, wherein the tool comprises a foam pad.

163. The system of claim 145, wherein the tool comprises a foam pad having between about 60 pores per inch to about 150 pores per inch.

164. The system of claim 145, wherein the tool comprises a crosslinked polyethylene foam pad having between about 60 pores per inch to about 150 pores per inch.

165. The system of claim 145, wherein the tool comprises a foam pad, wherein the foam pad has a plurality of cavities disposed within an upper surface of the foam pad, and wherein the cavities are substantially semi-spherical.

166. The system of claim 145, further comprising a plastic film for locating a stain or protrusion on the surface, the plastic film being sized to cover at least a portion of a human hand, the plastic film having a thickness between about 0.1 mm and about 0.75 mm.

167. The system of claim 145, further comprising a plastic film for locating a stain or protrusion on the surface, the plastic film being sized and adapted to cover at least a portion of a human hand, the plastic film having a modulus of elasticity according to ASTM test D882, Method A, of between about 50,000 psi and about 120,000 psi at 73° F., the plastic film having a thickness between about 0.1 mm and about 0.75 mm.

168. The system of claim 145 wherein the applicator further comprises a portion of a hook-loop fastening system located on a top surface of the body, the portion of a hook-loop fastening system being configured to form a fixable engagement with a complementary portion of a hook-loop fastening system attached to a surface of a handle during use.

169. The system of claim 145 wherein the surface comprises a surface.

170. The system of claim 145 wherein the applicator has a density that causes the applicator to float on water.

171. The system of claim 145, wherein the tool comprises a plastic flexible material having mixed therewith an abrasive comprising grains, and wherein the surface comprises a vehicle surface, and wherein the applicator has a density that causes the applicator to float on water.

172. The system of claim 145 further comprising a polishing compound.

173. The system of claim 145 wherein the tool is positionable within the cavity during use such that the body covers at least about half of a surface area of the tool.

174. The system of claim 145 wherein the body is a substantially circular disk, and wherein the cavity has a substantially circular shape.

* * * * *

UNITED STATES PATENT AND TRADEMARK OFFICE

CERTIFICATE OF CORRECTION

PATENT NO. : 6,547,643 B1
DATED : April 15, 2003
INVENTOR(S) : Miller III et al.

It is certified that error appears in the above-identified patent and that said Letters Patent is hereby corrected as shown below:

Column 24,
Line 37, please delete “a surface.” and substitute therefor -- a vehicle surface. --.

Column 25,
Line 39, please delete “a surface.” and substitute therefor -- a vehicle surface. --.

Column 26,
Line 45, please delete “a surface.” and substitute therefor -- a vehicle surface. --.

Column 29,
Line 33, please delete “D882,” and substitute therefor -- D-882, --.

Column 32,
Line 57, please delete “the cavities are,” and substitute therefor -- the cavities are --.
Line 67, please delete “D882,” and substitute therefor -- D-882, --.

Column 33,
Line 12, please delete “a surface.” and substitute therefor -- a vehicle surface. --.

Column 35,
Line 5, please delete “D882,” and substitute therefor -- D-882, --.
Line 17, please delete “a surface.” and substitute therefor -- a vehicle surface. --.

Signed and Sealed this

Twenty-third Day of September, 2003

JAMES E. ROGAN
*Director of the United States Patent and Trademark Office*